US009256194B2

(12) United States Patent
Nakajima et al.

(10) Patent No.: US 9,256,194 B2
(45) Date of Patent: Feb. 9, 2016

(54) DEVELOPER SUPPLY CONTAINER

(71) Applicant: CANON KABUSHIKI KAISHA, Tokyo (JP)

(72) Inventors: Nobuo Nakajima, Higashimatsuyama (JP); Yutaka Ban, Tokyo (JP); Fumio Tazawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/768,059

(22) Filed: Feb. 15, 2013

(65) Prior Publication Data

US 2013/0216259 A1 Aug. 22, 2013

(30) Foreign Application Priority Data

Feb. 17, 2012 (JP) ..... 2012-032393

(51) Int. Cl.
*G03G 15/04* (2006.01)
*G03G 15/08* (2006.01)
*G03G 21/16* (2006.01)

(52) U.S. Cl.
CPC ..... *G03G 21/1676* (2013.01); *G03G 15/0872* (2013.01); *G03G 15/0837* (2013.01)

(58) Field of Classification Search
CPC ..... G03G 15/0834; G03G 15/0836; G03G 15/0837; G03G 15/0839
USPC ..... 399/106, 119, 262
See application file for complete search history.

(56) References Cited

U.S. PATENT DOCUMENTS 5,579,101 A 11/1996 Omata et al.
5,983,059 A * 11/1999 Oka et al. ..... 399/262
6,131,008 A 10/2000 Kanamori et al.
6,292,644 B1 9/2001 Goto et al.
6,314,261 B1 11/2001 Omata et al.
6,438,345 B1 8/2002 Ban et al.
6,493,516 B2 12/2002 Murakami et al.

(Continued)

FOREIGN PATENT DOCUMENTS

JP 58113960 A * 7/1983
JP H04-336566 A 11/1992

(Continued)

OTHER PUBLICATIONS

Japanese Office Action dated Dec. 1, 2015, in related Japanese Patent Application No. 2012-032393.

*Primary Examiner* — Erika J Villaluna
(74) *Attorney, Agent, or Firm* — Fitzpatrick, Cella, Harper & Scinto

(57) ABSTRACT

A developer container is detachably mountable to a developer replenishing apparatus and includes a cylindrical accommodation member for accommodating a developer and a coupling portion for engaging with a main assembly coupling portion provided on the developer replenishing apparatus by movement in an inserting direction. In addition, a contact portion contacts an urging portion in the developer replenishing apparatus and receives a push-off force from the developer replenishing apparatus in a direction opposite to the inserting direction, and an engaging portion is engageable with an opening and closing portion provided in the developer replenishing apparatus to receive a force from the opening and closing portion in the inserting direction and against the push-off force in a closing operation of the opening and closing portion when the developer container is inserted into the developer replenishing apparatus.

7 Claims, 16 Drawing Sheets

(56) References Cited

U.S. PATENT DOCUMENTS

| | | | | |
|---|---|---|---|---|
| 6,766,133 | B1 | 7/2004 | Ban et al. | |
| 6,934,494 | B2 | 8/2005 | Yamada et al. | |
| 6,947,690 | B2 | 9/2005 | Tazawa et al. | |
| 7,039,347 | B2 | 5/2006 | Yamada et al. | |
| 7,352,975 | B2 * | 4/2008 | Fujiwara et al. | 399/12 |
| 7,412,192 | B2 | 8/2008 | Nakajima et al. | |
| 7,450,890 | B2 | 11/2008 | Murakami et al. | |
| 7,496,319 | B2 | 2/2009 | Takashima et al. | |
| 8,000,614 | B2 | 8/2011 | Okino et al. | |
| 2007/0183812 | A1 | 8/2007 | Takashima et al. | |
| 2009/0129825 | A1 | 5/2009 | Okino et al. | |

FOREIGN PATENT DOCUMENTS

| | | | |
|---|---|---|---|
| JP | 4-346378 | A | 12/1992 |
| JP | 2001-222158 | A | 8/2001 |
| JP | 2003-066704 | A | 3/2003 |
| JP | 2003-316139 | A | 11/2003 |
| JP | 2004-151209 | A | 5/2004 |
| JP | 2006-126584 | A | 5/2006 |
| JP | 2006-235147 | A | 9/2006 |
| JP | 2007-212791 | A | 8/2007 |
| JP | 2010-175804 | A | 8/2010 |
| JP | 2010-241468 | A | 10/2010 |

* cited by examiner (a)

(b)

(a)

(b)

(a)

(b)

DEVELOPER SUPPLY CONTAINER

FIELD OF THE INVENTION AND RELATED ART

The present invention relates to a developer supply container which is used by an image forming apparatus such as a copying machine, a printer, and a facsimile machine.

An electrophotographic image forming apparatus (which hereafter may be referred to simply as "apparatus main assembly") such as an electrophotographic copying machine and an electrophotographic printer uses microscopically particulate developer. As the developer in the main assembly of an electrophotographic image forming apparatus is used up, a developer supply container is used to replenish the apparatus main assembly with developer. Thus, various technologies have been proposed to improve an electrophotographic image forming apparatus and a developer supply container therefor, in terms of the operational efficiency with which the apparatus main assembly is replenished with developer.

In the case of the electrophotographic image forming apparatus and the developer supply container therefor disclosed in Japanese Laid-open Patent Application H04-346378, they are structured so that the developer supply container is locked to the developer supply container holder of the apparatus main assembly by a developer supply container locking means, at the developer delivery position. Thus, when the developer supply container is in the developer delivery position, the developer supply container is kept under the pressure generated by a spring (springs) with which the developer supply container holder is provided. Therefore, as the developer supply container locking means is released, the developer supply container is automatically raised from the developer delivery position by the resiliency of the spring, making it easier for an operator of the image forming apparatus to know that the developer supply container is ready to be removed from the apparatus main assembly.

The structural arrangement disclosed in Japanese Laid-open Patent Application H4-346378 was problematic for the following reason: When it is necessary for an operator of the image forming apparatus to replace the developer supply container in the apparatus main assembly, the operator has to press the lid (door) of the developer supply container holder, in order to disengage the locking mechanism which keeps the developer supply container locked in the developer supply container holder. This process of pressing the lid (door) of the developer supply container holder added to the steps for replacing the developer supply container.

The developer supply container disclosed in Japanese Laid-open Patent Application H04-346378 is of the so-called "single action delivery type". That is, in the case of this developer supply container, as soon as the developer supply container is installed into the apparatus main assembly, the developer in the developer supply container is automatically supplied in entirety into the apparatus main assembly, and then, the container is to be removed from the apparatus main assembly as soon as the container is emptied. Thus, an operator has to wait while the entirety of the developer in the developer supply container is transferred into the apparatus main assembly. Therefore, this method is longer in the length of time it takes to replenish the image forming apparatus with developer.

In comparison, the developer supply container disclosed in Japanese Laid-open Patent application 2010-175804 uses a delivery method of the so-called trickle-delivery type. That is, the developer in the container is delivered into the apparatus main assembly little by little after the installation of the developer supply container into the apparatus main assembly by an operator. Thus, the container is left in the apparatus main assembly until the container becomes empty.

Further, the developer replenishment device disclosed in Japanese Laid-open Patent application 2010-175804 is provided with a pressure applying means for pressing the sealing member for sealing the developer delivery opening of the developer supply container, in the direction in which the container is removed from the apparatus main assembly, when the developer supply container is removed from the main assembly of the image forming apparatus. Thus, when the developer supply container is removed from the apparatus main assembly, first, the developer supply container is allowed to move rearward to allow the sealing member to seal the developer delivery opening, and then, the sealing member is disengaged from the apparatus main assembly, so that the developer supply container is pushed out of the apparatus main assembly, from the front side of the main assembly, by the resiliency of the pressure applying means, making it easier for an operator to be sure that the developer supply container has been completely disengaged from the apparatus main assembly, and therefore, can be removed from the apparatus main assembly.

However, the developer supply container disclosed in Japanese Laid-open Patent Application 2010-175804 also is problematic. That is, when it is necessary to install the developer supply container into the apparatus main assembly, the container has to be inserted into a specific position, because if it is not inserted into the specific location in the apparatus main assembly, it sometimes fails to be properly positioned to be properly engaged with the apparatus main assembly. That is, if the developer supply container is not in the preset position in the apparatus main assembly, the sealing member fails to be properly disengaged from the apparatus main assembly, failing thereby to unseal the developer delivery opening. Consequently, the developer supply container fails to supply the apparatus main assembly with the developer in the developer supply container.

Knowing the above-described problem, the inventors of the present invention came up with a combination of an image forming apparatus and a developer supply container, which has the following structural features. More specifically, the main assembly of the apparatus and developer supply container are structured so that if the developer supply container fails to be inserted into the apparatus main assembly far enough to be placed in the preset position in the apparatus main assembly, the developer supply container is pushed back in the opposite direction to the direction in which the developer supply container was pushed into the apparatus main assembly. Further, in order to make it easier for an operator to know that the developer supply container is in the preset position in the apparatus main assembly, the combination of the apparatus main assembly and developer supply container is provided with a developer supply container locking mechanism that locks the developer supply container in the proper position as soon as the developer supply container is moved into the preset position in the apparatus main assembly.

With the provision of this locking mechanism, unless the developer supply container is inserted by an operator all the way into the position where it is locked in by the developer supply container locking mechanism, it is pushed back by the locking mechanism. Thus, the operator can know whether or not the operator successfully installed the container.

However, this method also is problematic. That is, if the locking mechanism is structured so that when a developer supply container in the apparatus main assembly needs to be removed, the container has to be forcefully pulled out by an operator. Thus, this method is inferior in terms of the operability. Obviously, this problem can be solved by providing the image forming apparatus with a mechanism for unlocking the mechanism for locking the developer supply container. This solution, however, adds an additional step to the procedure for removing a developer supply container from the apparatus main assembly, and also, increases an image forming apparatus and a developer supply container therefor in cost and size, because the unlocking mechanism has its own cost and requires its own space.

SUMMARY OF THE INVENTION

Thus, the primary object of the present invention is to provide a combination of an image forming apparatus and a developer supply container therefor, which is structured so that the developer supply container can be simply installed into, or removed from, the main assembly of the image forming apparatus, and therefore, is superior in operability to any combination of an image forming apparatus and a developer supply container in accordance with the prior art.

According to an aspect of the present invention, there is provided a developer container detachably mountable to a developer replenishing apparatus, comprising a cylindrical accommodation member for accommodating a developer; a drive receiving portion, provided at one end portion side of the accommodation member, for receiving a rotational force from a developer replenishing apparatus; an opening for permitting the of the developer through said accommodation member; a feeding portion for feeding the developer to said opening by rotating said accommodation member by the rotational force received by said drive receiving portion; a contact portion for contacting an urging portion provided in said developer replenishing apparatus to urge said developer container in a direction opposite an inserting direction in which said developer container is inserted into the developer replenishing apparatus, when said developer container is mounted to the developer replenishing apparatus; and an engaging portion provided upstream of said contact portion with respect to the inserting direction, said engaging portion being engageable with an opening and closing portion provided in the developer replenishing apparatus when said developer container is mounted to the developer replenishing apparatus.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the developer supply container and developer supply system which are in accordance with the present invention are described with reference to the appended drawings.

Embodiment

Figure 1:
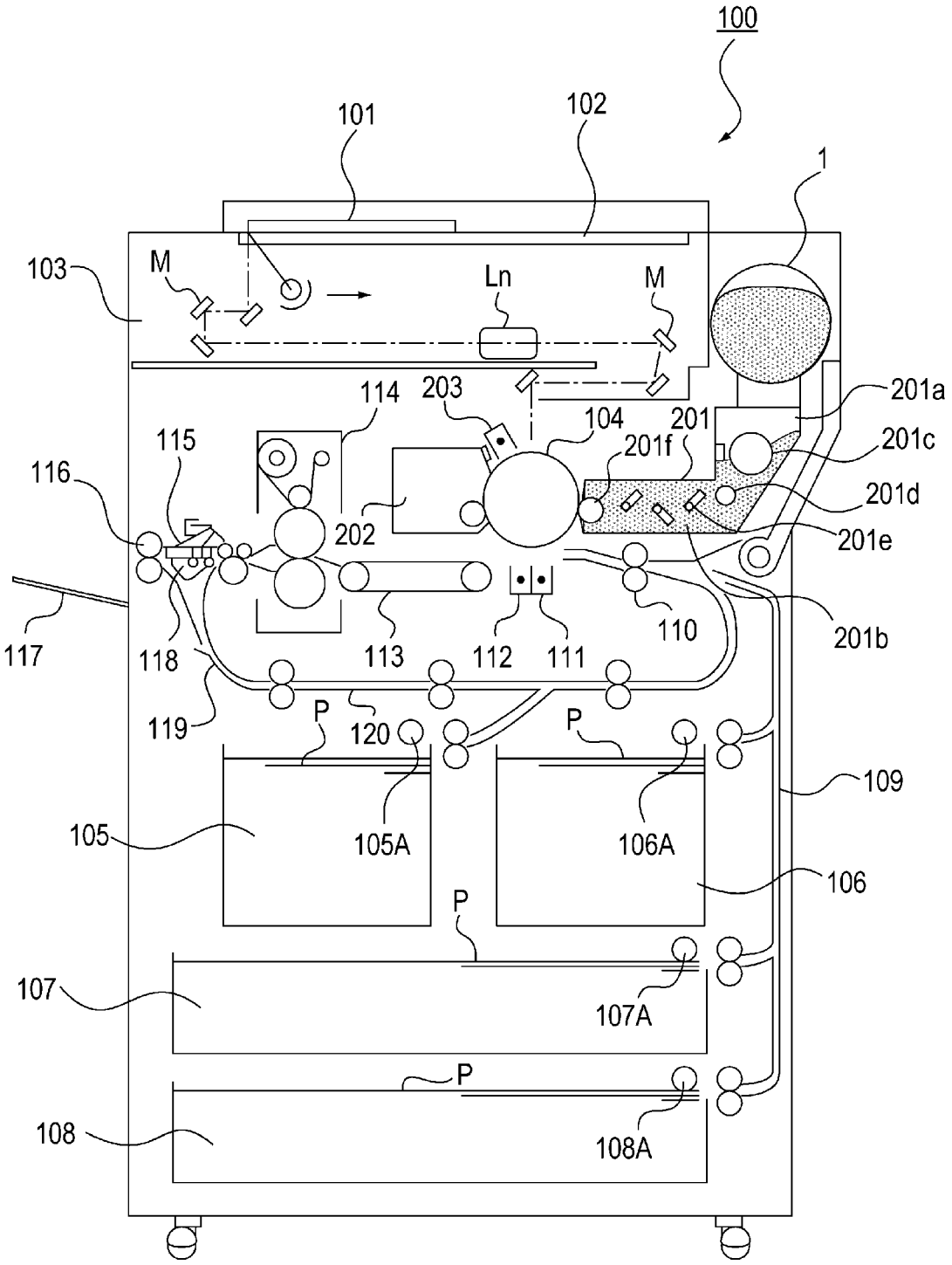
FIG. 1 is a sectional view of a typical image forming apparatus to which the present invention is applicable.
Figure 2:
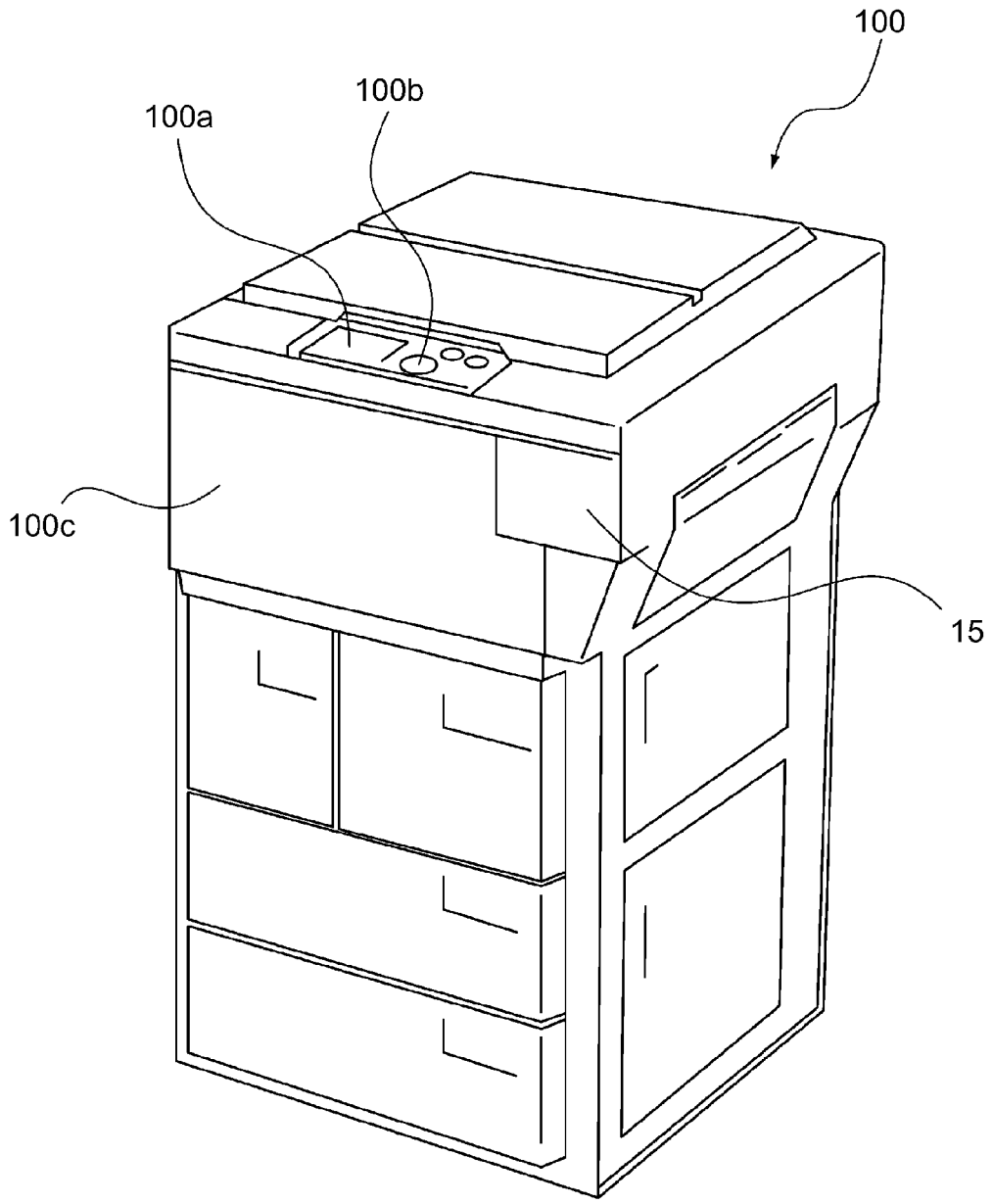
FIG. 2 is a perspective view of the image forming apparatus shown in FIG. 1.
Figure 3:
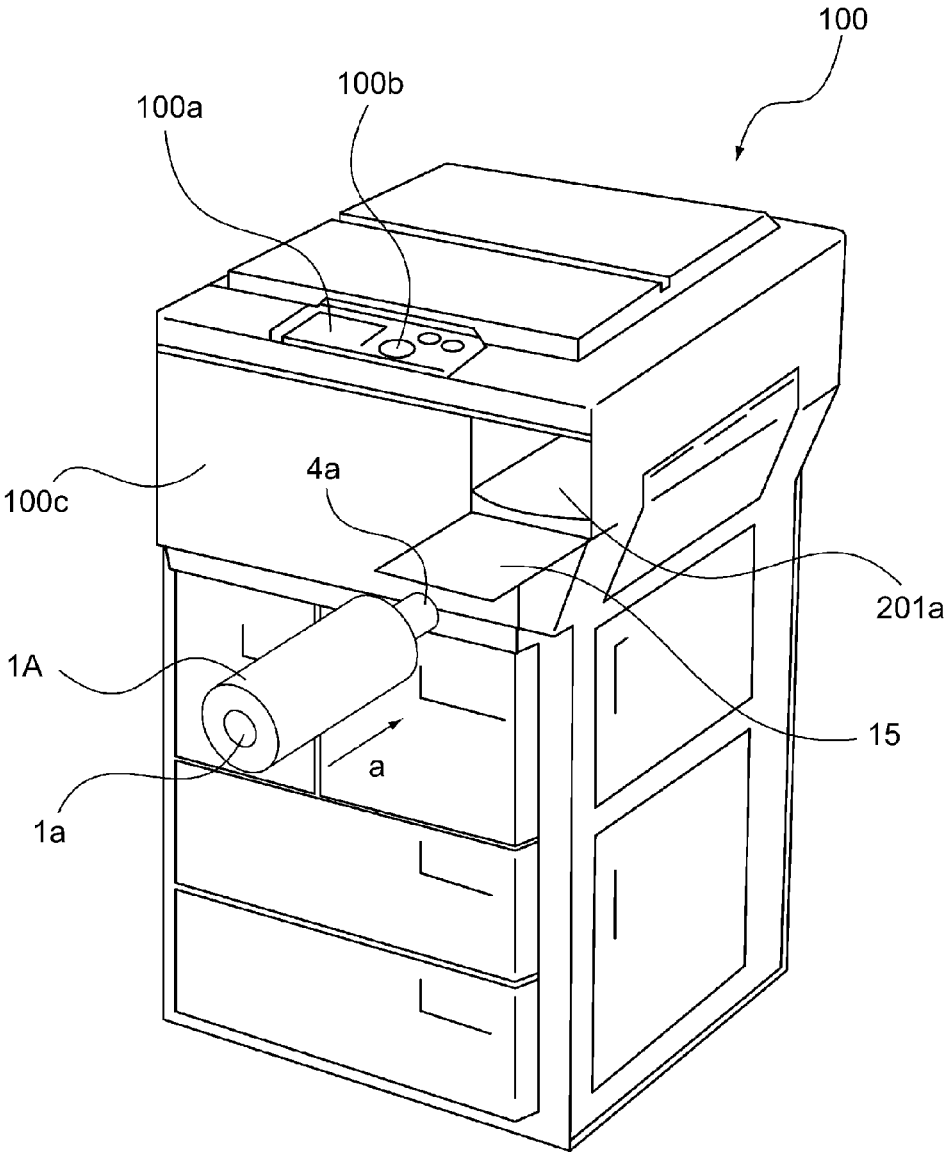
FIG. 3 is a perspective view of the image forming apparatus shown in FIG. 1, which is ready for the installation of a developer supply container into the main assembly of the apparatus.

First, referring to FIGS. 1-3, a typical electrophotographic image forming apparatus in which a developer supply container (as developer container) in accordance with the present invention is installable, is described.

<Electrophotographic Image Forming Apparatus>

As an original 101 is placed on the original placement glass platen 102 of the main assembly of the electrophotographic copying machine 100 (which hereafter may be referred to simply as "apparatus main assembly") shown in FIG. 1, an optical image which reflects the information of the original 101 is formed on the peripheral surface of the electrophotographic photosensitive drum 104 (which hereafter is referred to as "photosensitive drum") by a combination of multiple mirrors M and a lens Ln of the optical section 103. The apparatus main assembly 100 is provided with four recording medium cassettes 105, 106, 107 and 108, which are different in the size of a sheet of recording medium (which hereafter will be referred to as sheet of paper) which are stored in layers in the cassettes. A cassette which contains sheets P of paper which are most suitable for the original 101 is selected among the four sheet cassettes 105, 106, 107 and 108, based on the information inputted by a user (operator) through the control panel 101*a* shown in FIG. 2, or the recording medium size of the original. The choice of the recording medium is not limited to a sheet of paper. For example, it may be a sheet of film for an OHP.

One of the sheets P of paper in the selected recording medium cassette is fed into the apparatus main assembly 100 by the sheet separating/conveying device 105A, 105B, 105C or 105D. Then, it is conveyed to a pair of registration rollers 110 through the recording medium conveyance passage 109. Then, the sheet P of paper is conveyed by the pair of registration rollers 110 to the transfer station, in synchronism with the rotation of the photosensitive drum 104 and the timing with which the peripheral surface of the photosensitive drum 104 is scanned by the optical section 103. In the transfer station, the developer image, that is, a visible image formed of the developer, on the peripheral surface of the photosensitive drum 104, is transferred onto the sheet P of paper, with the use of the transfer discharger 111. Then, the sheet P of paper, on which the developer image is present, is separated from the photosensitive drum 104 by the separation discharger 112.

Thereafter, the sheet P of paper is conveyed to the fixing section 114 by the sheet conveyance section 113. In the fixing section 114, the developer image on the sheet P is fixed to the sheet P by the heat and pressure applied to the sheet P and the developer image thereon, by the fixing section 114. Then, if the image forming apparatus is in the one-side printing mode, the sheet P is moved through the sheet discharging/reversing section 115, and is discharged into the delivery tray 117 by a pair of discharge rollers 116. If the apparatus is in the two-sided mode, the sheet P is conveyed into the recording medium re-feeding passage 119 by the flapper 118 of the discharging/reversing section 115, and then, is conveyed to the pair of registration rollers 110 through the recording medium re-feeding passage 120. Then, it is discharged into the delivery tray 117 after being conveyed though the same passages as those through which it conveyed in the one-sided mode.

Further, if the image forming apparatus is in the mode in which two (or more) images are placed in layers on the same surface of the sheet P of paper, the sheet P is moved through the sheet discharging/reversing section 115 after being conveyed out of the fixing section 114. Then, the sheet P is almost entirely moved out of the apparatus main assembly 100, with its trailing edge being on the downstream side of the flapper 118, and its end portion remaining pinched by the pair of discharge rollers 116. Then, while the trailing end portion of the sheet P is still remaining in the nip between the pair of discharge rollers 116, the flapper 118 is switched in attitude and the discharge rollers 116 are rotated in reverse. Thus, the sheet P is conveyed back into the apparatus main assembly 100. Then, the sheet P is conveyed to the pair of registration rollers 110 by way of the re-feeding passages 119 and 120. Then, it is conveyed through the same route as that through which it is conveyed in the one-sided mode, and is discharged into the delivery transfer 117.

Regarding the structure of the apparatus main assembly 100, the developing section 210, cleaning section 202, and primary charging device 203, etc., are positioned in the adjacencies of the peripheral surface of the photosensitive drum 104.

The developing section 210 is a section for developing an electrostatic latent image formed on the peripheral surface of the photosensitive drum 104 by the optical section 103 based on the information of the original 101, into a visible image with the use of developer.

The developing section 201 has a developer hopper 201*a* and a developing device 201*b*. The developer hopper 201*a* has a developer conveying member 201*c* which is for conveying, while stirring, the developer in the developing device 1, after the delivery of the developer into the developing device 201*b* from the developer supply container 1. After being stirred by the developer conveying member 201*c* while being conveyed by the developer conveying member 201*c*, the developer is sent to the developing device 201*b* by a magnetic roller 201*d*. The developing device 201*b* has a development roller 201*f* and a developer conveying member 201*e*. After being conveyed into the developing device 201*b* from the developer hopper 201*a* by the magnetic roller 201*d*, the developer is sent to the development roller 201*f* by the developer conveying member 201*e*. Then, the developer is supplied to the photosensitive drum 104 by the development roller 201*f*.

The cleaning section 202 is for removing the developer remaining on the peripheral surface of the photosensitive drum 104 after the transfer of the developer image from the photosensitive drum 104. The primary charging device 203 is for charging the photosensitive drum 104.

Referring to FIG. 2 which is a perspective view of the image forming apparatus shown in FIG. 1, as seen from diagonally above the apparatus, the apparatus main assembly 100 is provided with a door 15 (which hereafter will be referred to as "front door") which is to be opened or closed when the developer supply container in the apparatus main assembly 100 is replaced. In order to make it easier for an operator to replace the developer supply container, the front door 15 is placed in the top right corner of the apparatus main assembly 100 as seen from the front side of the apparatus.

Referring to FIG. 3 which is a perspective view of the image forming apparatus shown in FIG. 1, when the front door 15 shown in FIG. 2 is kept open by the operator, the apparatus main assembly 100 is provided with the developer hopper 201*a*, which is within the apparatus main assembly 100. The developer hopper 201*a* is where the developer supply container 1A is to be inserted (installed). When it is necessary for an operator to install the developer supply container 1A into the apparatus main assembly 100, the operator is to insert the developer supply container 1A into the developer hopper 201*a* in the direction indicated by an arrow mark a, and to close the front door 15. As the front door 15 is closed, it becomes possible for the developer in the developer supply container 1A to be supplied to the apparatus main assembly 100. That is, the developer supply container 1A and apparatus main assembly 100 are structured so that the developer supply container 1A can be removably mounted in the developer hopper 201*a* which functions as the internal developer supplying device of the apparatus main assembly 100.

The operation for installing the developer supply container 1A into the apparatus main assembly 100 or removing the developer supply container 1A from the apparatus main assembly, and the structural arrangement that the front door 15 which can be opened or closed by an operator and functions as a part of the mechanism for placing the developer supply container 1A in a preset position in the apparatus main assembly 100 as it presses the developer supply container 1A, are described later in detail.

<Developer Hopper>

Figure 4:
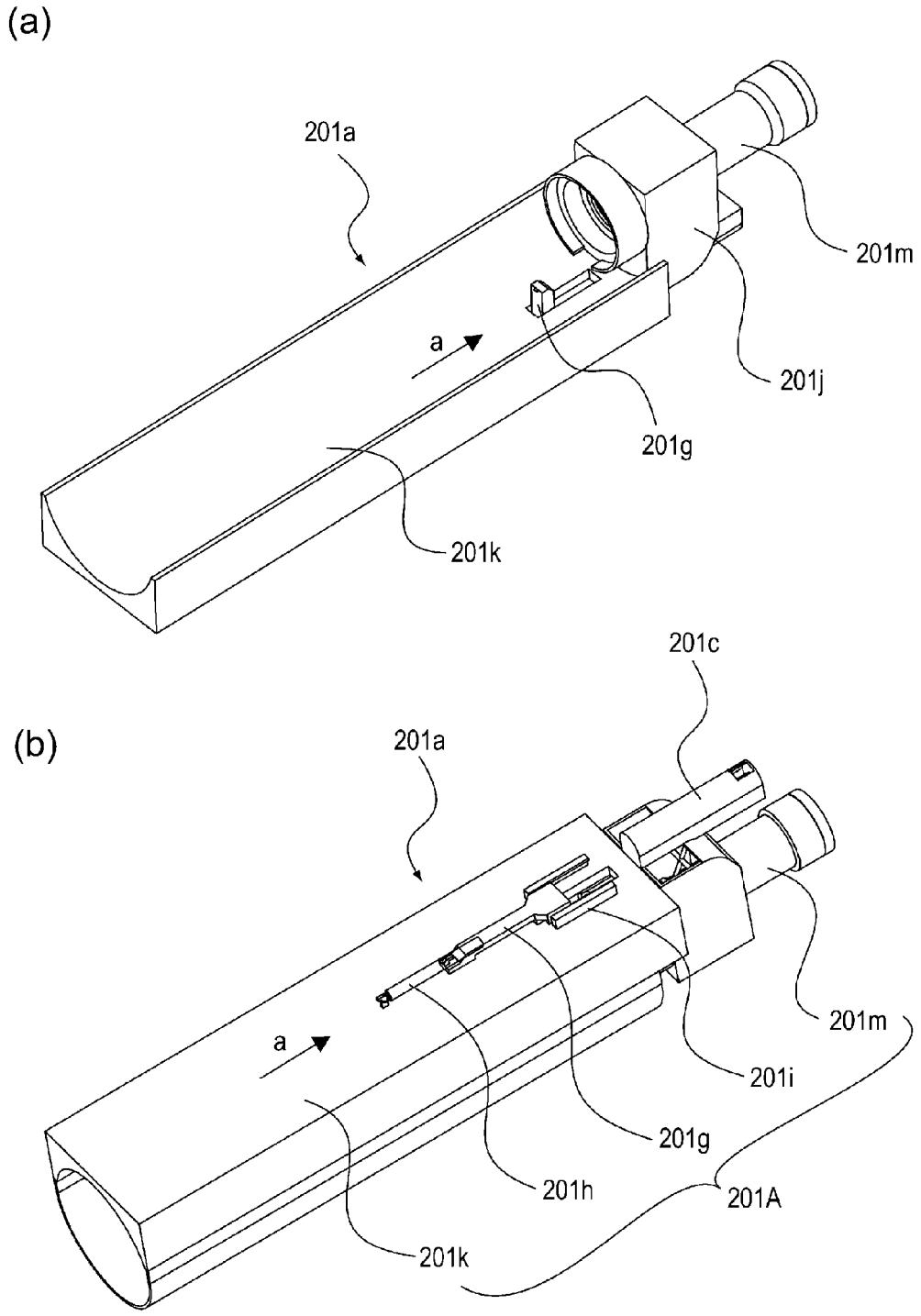
FIG. 4(*a*) is a perspective view of a developer supply container holder in an embodiment of the present invention, and FIG. 4(*b*) is a perspective view of the developer supply container holder, as seen from the underside of the holder.
Figure 5:
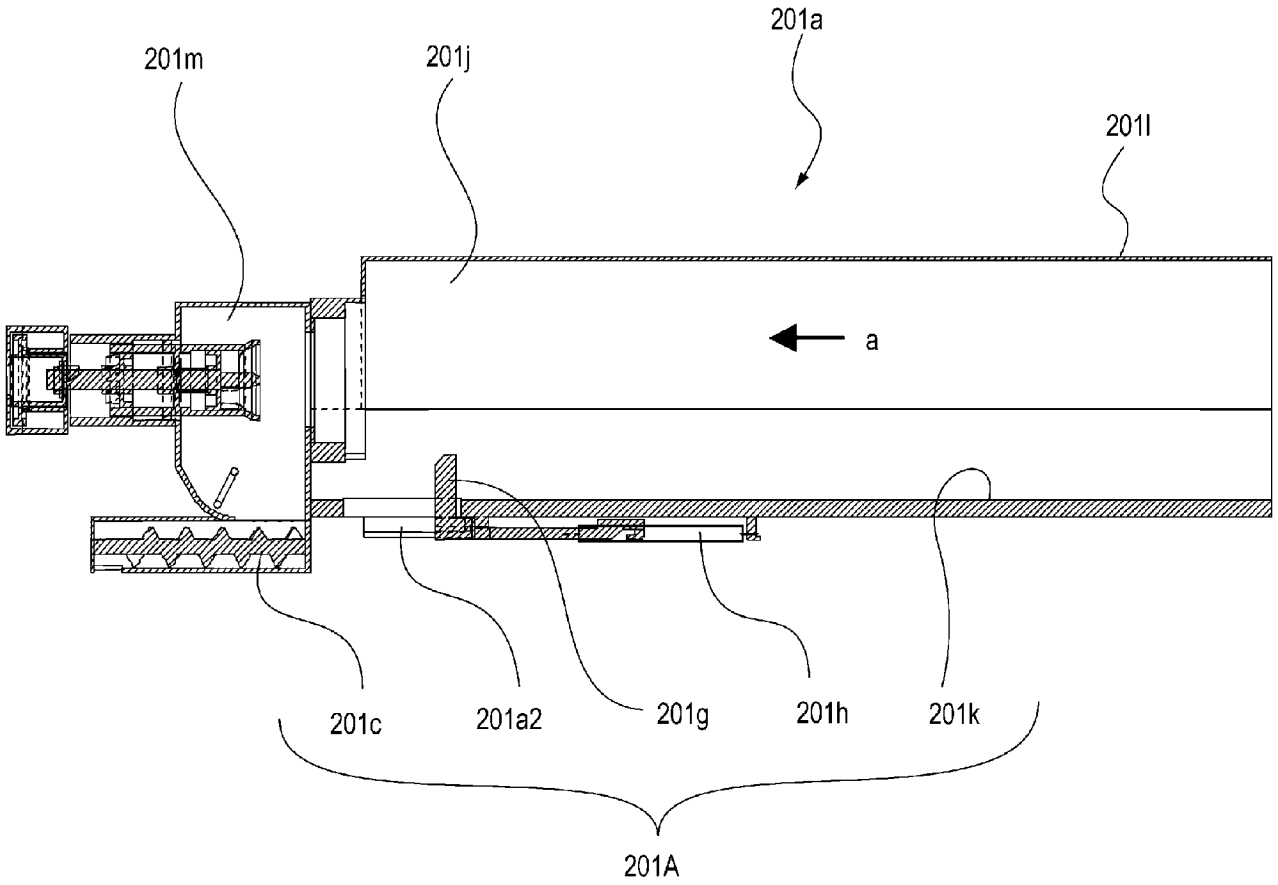
FIG. 5 is a sectional view of the developer supply container holder in the embodiment.

Next, referring to FIGS. 4 and 5, the developer hopper 201*a* is described in detail. FIG. 4(*a*) is a perspective view of the developer hopper 201*a*, and shows the structure of the hopper 201*a*. FIG. 4(*b*) is a perspective view of the developer hopper 201*a*, as seen from the underside of the hopper 201*a*. FIG. 5 is a sectional view of the developer hopper 201*a*.

The developer hopper 201*a* is provided with a developer chamber 201*j* in which the developer supplied from the developer supply container 1A is temporarily stored. It is also provided with the developer conveying member 201*c* for conveying the developer in the developer chamber 201*j* toward the apparatus main assembly 100. The developer conveying member 201*c* is below the developer chamber 201*j*.

Further, the developer hopper 201*a* is provided with a driving force transmitting section 201*m* which is for transmitting rotational driving force to the developer supply container 1A from the apparatus main assembly 100, and also, for unsealing the developer outlet 4*c*, with which the small diameter portion 4*a* of the developer supply container 1A (which will be described later in detail) is provided. The driving force transmitting section 201*m* unseals the developer outlet 4*c* of the developer supply container 1A by being engaged with the sealing member 2 (which will be described later) which keeps the developer supply container 1A sealed. The apparatus main assembly 100 and developer supply container 1A are structured so that rotational driving force can be transmitted to the developer supply container 1A from the motor (unshown) with which the apparatus main assembly 100 is provided, through the sealing member 2. More concretely, the developer supply container 1A is structured so that the sealing member 2 is movable relative to the developer supply container 1A (main section of developer supply container 1A) in the direction parallel to the axial line of the developer supply container 1A to seal or unseal the developer outlet 4*c* of the developer supply container 1A, and also, functions as the portion by which the developer supply container 1A receives the rotational driving force from the driving force transmitting portion 201*m* which is in the developer supplying device.

The developer hopper 201*a* is provided with a tray 201*k* which is for holding the developer supply container 1A. When the developer supply container 1A is installed into the apparatus main assembly 100, the developer supply container 1A is slid onto the tray 201*k*. Even while the developer supply container 1A is rotated, it remains in contact with this tray 201*k*. Thus, the tray 201*k* is made smooth; it is made as small as possible in friction. In this embodiment, the tray 201*k* is molded of ABS resin to provide the tray 201*k* with a smooth surface. However, roller bearings, ball bearings, or the like may be placed on the surface of the tray 201*k* to further reduce the friction between the tray 201*k* and developer supply container 1A.

Further, the developer hopper 201*a* is provided with a return mechanism 201A for pushing back the developer supply container 1A. The return mechanism 201A is a mechanism for pushing the developer supply container 1A back in the opposite direction from the direction in which the developer supply container 1A is inserted into the apparatus main assembly 100, which is parallel to the axial line of the developer supply container 1A, and about which the developer supply container 1A is rotated. The return mechanism 201A is made up of a container pushing member 201*g*, and a tension spring 201*h* anchored to the bottom portion of the tray 201*k*. Referring to FIG. 4(*a*), the container pushing member 201*g* is provided with a container pushing projection, which projects inward of the tray 201*k* through the narrow rectangular through hole of the developer hopper 201*a*. The tray 201*a* and container pushing member 201*g* are structured so that the container pushing (returning) member 201*g* can be slid, while being guided by a pair of guides 201*i*, in the direction (indicated by arrow mark a) in which the developer supply container 1A is inserted into the apparatus main assembly 100.

<Developer Supply Container>

Figure 6:
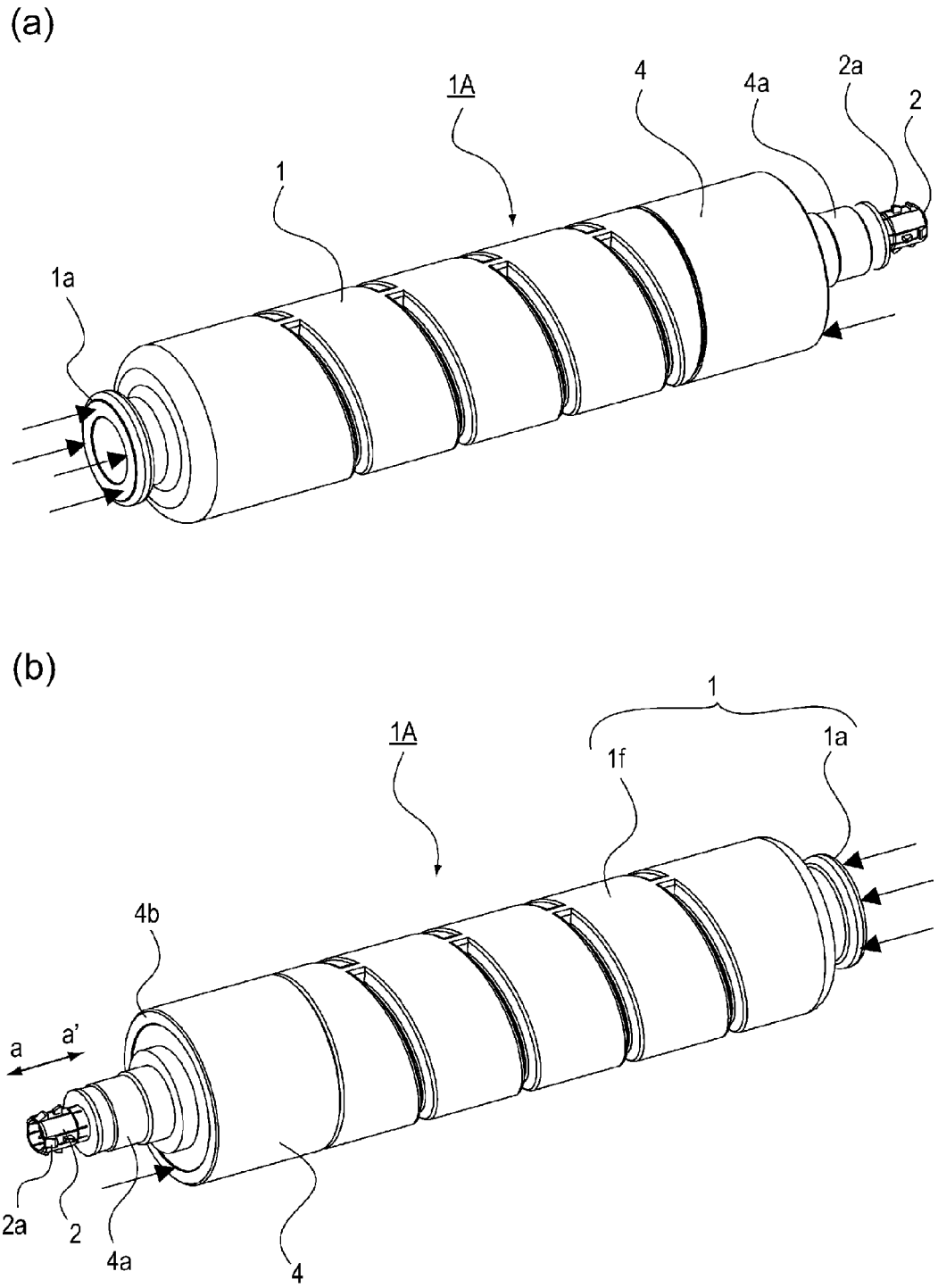
FIG. 6(*a*) is a perspective view of the developer supply container in the embodiment, as seen from the rear side of the container, and FIG. 6(*b*) is a perspective view of the developer supply container, as seen from the front side of the container.
Figure 7:
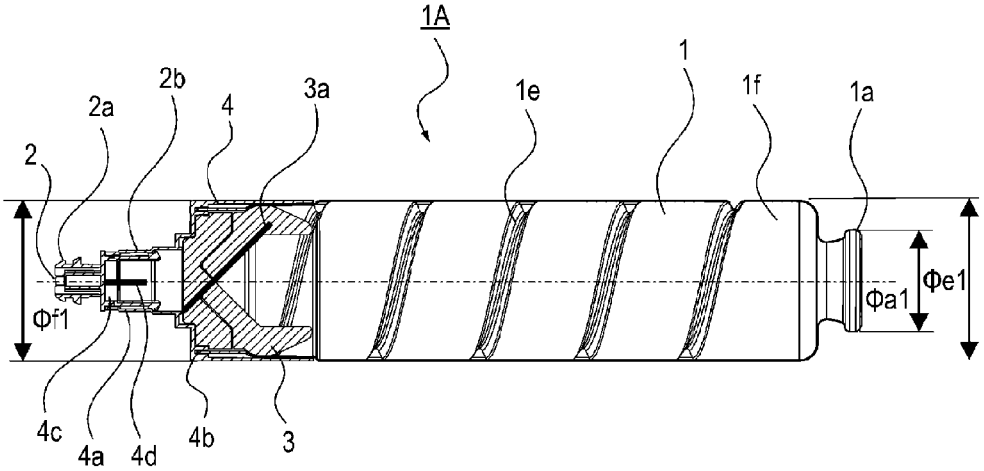
FIG. 7(*a*) is a sectional view of the developer supply container in the embodiment, and FIG. 7(*b*) is an enlarged sectional view of a combination of the sealing member and small diameter portion of the developer supply container in the embodiment, after the unsealing of the developer supply container.
Figure 7:
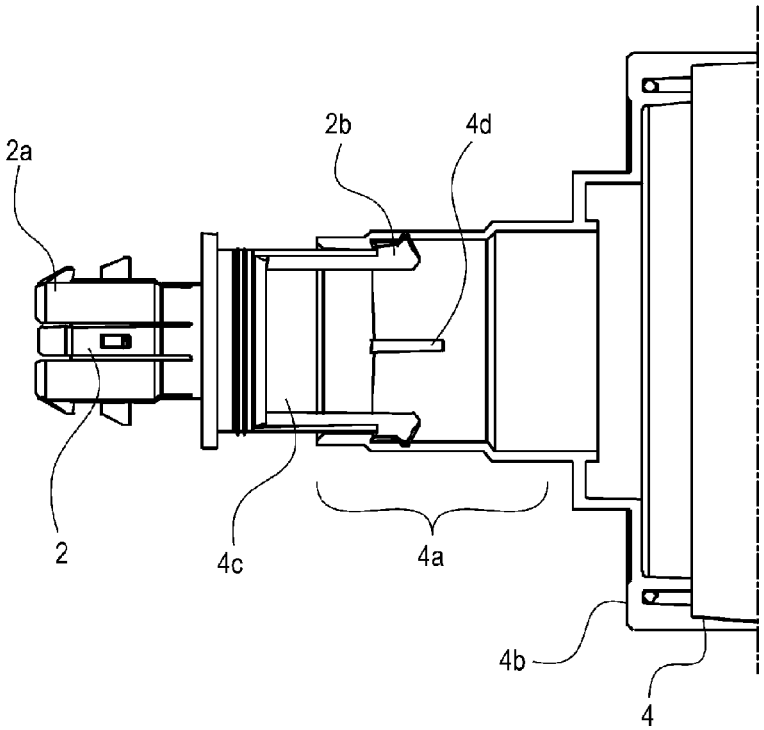

Next, referring to FIGS. 6 and 7, the developer supply container 1A in accordance with the present invention is described. FIG. 6(*a*) is a perspective view of the developer supply container 1A in the this embodiment, as seen from the rear side of the container, and FIG. 6(*b*) is a perspective view of the developer supply container, as seen from the front side of the container. FIG. 7(*a*) is a sectional view of the developer supply container 1A in this embodiment, at a plane which coincides with the axial line of the developer supply container 1A, and FIG. 7(*b*) is an enlarged sectional view of a combination of the sealing member 2 and the small diameter portion of the developer supply container 1A in the embodiment, after the sealing member 2 was moved into the position in which it keeps open the outlet 4*c* of the developer supply container 1A.

Referring to FIGS. 6 and 7, the developer supply container 1A has: the main section 1, which is hollow and roughly cylindrical; a developer conveying member 3 which conveys the developer in the main section 1 by scooping up the developer; a flange 4 attached to the front end of the main section 1 to seal the front end of the main section 1; and the sealing member 2 which keeps sealed the outlet 4*c* of the developer supply container 1A.

The main section 1 is provided with a spiral ridge le, which is on the inward surface of the main section 1. Thus, as the developer supply container 1A is rotated, the developer in the main section 1 is conveyed toward the developer outlet 4*c* of the flange 4 by the spiral ridge 1*e*. Incidentally, the main section 1 in this embodiment was manufactured by injection blow molding, which is high in productivity and can produce a cylindrical container which is thin in wall thickness. However, it may be manufactured by one of various molding methods other than injection blow molding. For example, it may be manufactured by direct blow molding or ordinary injection molding.

The developer conveying member 3 is attached to the main section 1 as an integral part of the main section 1. Thus, as the main section 1 is rotated, the conveying member 3 rotates with the main section 1. The conveying member 3 is provided with a pair of plates 3*a* which are slanted relative to the axial line of the main section 1 and are symmetrically positioned with reference to the axial line of the main section 1.

As the developer supply container 1A is rotated, the spiral ridges le and conveying member 3 function together as a developer conveying means for conveying the developer in the main section 1 toward the small diameter portion 4*a* of the main section 1.

The flange 4 is provided with the small diameter portion 4*a*, which is cylindrical. The external diameter of the small diameter portion 4*a* is smaller than the external diameter ϕf of the main section of the flange 4. The aforementioned developer outlet 4*c*, through which the developer in the main section 1 is discharged, is at the front end of the flange 4. The external diameter ϕf of the flange 4 is roughly the same as the external diameter ϕe1 of the main section 1. Further, the inward surface of the small diameter portion 4*a*, in terms of the diameter direction of the flange 4, is provided with a ridge 4*d* which regulates the rotation of the developer supply container 1A by engaging with a pair of catches (which will be described later) with which the sealing member 2 is provided.

Further, the sealing member 2 is provided with a pair of catches 2*a*, which are shaped so that they can snap-fit with the driving force transmitting portion 201*m* by elastically deforming, in terms of not only in the direction parallel to the axial line of the developer supply container 1A, but also, in the diameter direction of the developer supply container 1A. Further, the sealing member 2 is provided with the aforementioned pair of catches 2*b*, which engage with the aforementioned ridge 4*d* of the flange 4 as the developer supply container 1A is rotated. Thus, the sealing member 2 is allowed to move relative to the developer supply container 1A in the direction parallel to the axial line of the developer supply container 1A to unseal the developer outlet 4*a* (developer supply container 1A), and also, can rotate with the developer supply container 1A as the developer supply container 1A is rotated.

Further, the flange 4 is provided with the return force catching (bearing) portion 4*b* (area of contact) for catching (bearing) the force generated by the developer supply container return mechanism 201A. The return force catching portion 4*b* is positioned so that it is at the downstream end of the developer supply container 1A in terms of the direction in which the developer supply container 1A is inserted into the apparatus main assembly 100. The return force catching portion 4*b* has to be capable of bearing the pressure generated by the returning member 201*g*, even while the developer supply container 1A is rotated. Thus, it is made in the form of a ring which is larger in diameter than the small diameter portion 4*a*, and is coaxial with the rotational axis of the flange 4 (developer supply container 1A). It is flat and smooth across its load bearing surface area.

Further, the developer supply container 1A is provided with a front door catching portion 1*a*, with which the front door 15 of the apparatus main assembly 100 comes into contact to regulate the movement of the developer supply container 1A when the developer supply container 1A is installed into the apparatus main assembly 100. The front door catching portion 1*a* is on the opposite end of the developer supply container 1A from where the small diameter portion 4*a* is attached to the developer supply container 1A. That is, the front door catching portion 1*a* is at the upstream end of the developer supply container 1A in terms of the direction in which the developer supply container 1A is inserted into the apparatus main assembly 100, that is, at the opposite end of the developer supply container 1A from the small diameter portion 4*a*. This structural arrangement requires no space between the wall of the developer hopper 201*a* and developer supply container 1A in terms of the diameter direction of the developer supply container 1A, and therefore, can improve the apparatus main assembly 100 in volumetric efficiency compared to a structural arrangement which provides the peripheral surface of the developer supply container 1A with such a projection as the aforementioned spiral ridge le to regulate the developer supply container 1A. More specifically, providing the peripheral surface of the developer supply container 1A with a projection (spiral ridge, for example) for regulating the developer supply container 1A requires the apparatus main assembly 100 to be provided with a space for accommodating the projection (projections), across the entirety of the adjacencies of the peripheral surface of the developer supply container 1.

Further, the front door catching portion 1*a* (which hereafter will be referred to simply as "door catching portion") is cylindrically formed as an integral part of the apparatus main assembly 100 so that it projects rearward in the direction parallel to the axial line of the developer supply container 1A. Further, it is shaped so that the developer supply container 1A appears constricted across the portion corresponding to the base portion of the front door catching portion 1*a*, making it easier for an operator to grasp the developer supply container 1A when the operator installs the developer supply container 1A into the apparatus main assembly 100, or to remove the developer supply container 1A from the apparatus main assembly 100. Further, in order to make it easier for the developer supply container 1A to be inserted into the apparatus main assembly 100 in the direction indicated by the arrow mark a, by the force applied thereto by the front door 15 of the apparatus main assembly 100, the external diameter ϕa1 of the door catching portion 1*a* is made smaller than the external diameter ϕe1 of the main section 1 of the developer supply container 1A. The principle based on which the developer supply container 1A is moved in the direction indicated by the arrow mark a by the pivotal movement of the front door 15 is described next in detail.

The developer supply container 1A in accordance with the present invention is provided with the return force catching (bearing) portion 4*b* which catches and bears the force generated by the return mechanism 201A of the apparatus main assembly 100, and the front door catching portion 1*a* which causes the force applied to the door catching portion 1*a* by the front door 15 of the apparatus main assembly 100, to work in the direction to move the developer supply container 1A inward of the apparatus main assembly 100 in the direction parallel to the axial line of the developer supply container 1A. Next, the function of the developer supply container returning mechanism 201A of the apparatus main assembly, and the function of the developer supply container return force catching (bearing) portion 4*b* of the developer supply container 1A are described in detail.

<Operation for Inserting Developer Supply Container into Apparatus Main Assembly>

Figure 8:
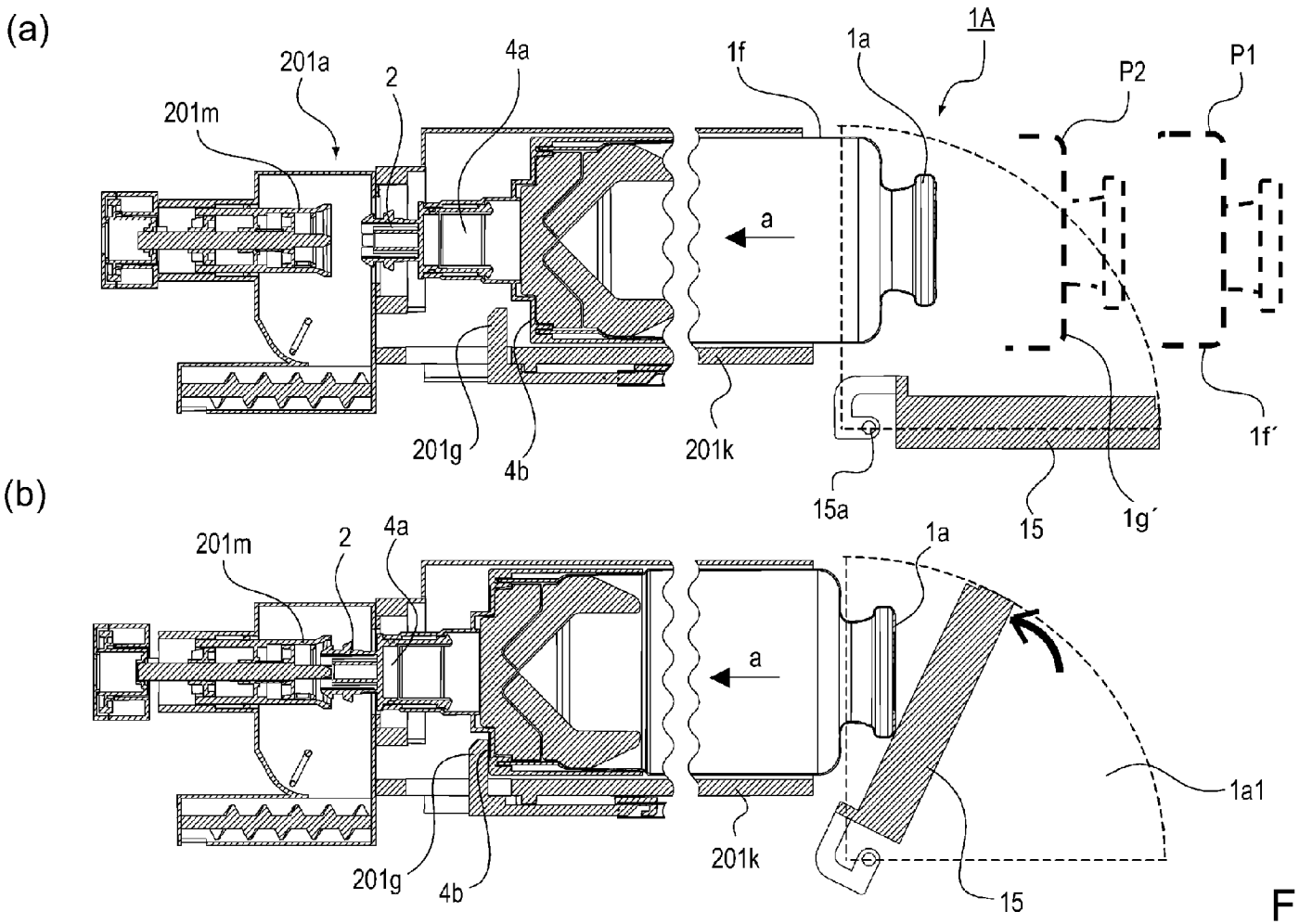
FIGS. 8(*a*) and 8(*b*) are sectional views of the developer supply container before and during, respectively, the early stage of the insertion of the container into the apparatus main assembly.
Figure 9:
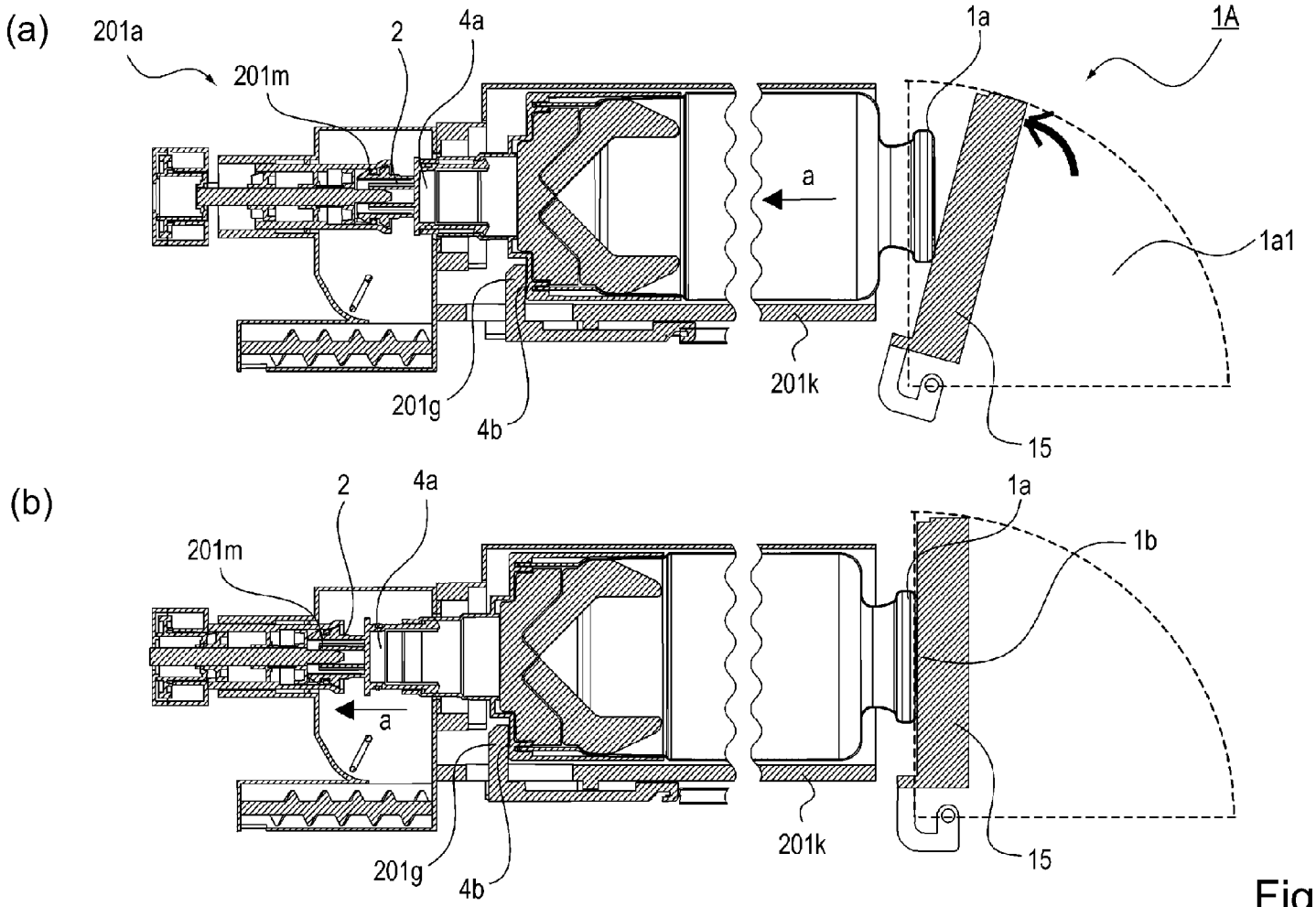
FIGS. 9(*a*) and 9(*b*) are sectional views of the developer supply container during and after, respectively, the final stage of the insertion of the container into the apparatus main assembly.

Next, referring to FIGS. 8 and 9, the operation for inserting the developer supply container 1A in accordance with the present invention into the apparatus main assembly 100 is described. FIGS. 8(*a*), 8(*b*), 9(*a*) and 9(*b*) are sectional views of the combination of the developer supply container 1A, and the front door 15 of the apparatus main assembly 100, which show the steps, one for one, through which the developer supply container 1A is inserted into the apparatus main assembly 100.

FIG. 8(*a*) shows the state of the combination of the developer supply container 1A and front door 15, immediately after the operator has finished placing the developer supply container 1A on the tray 201*k* (operator has not begun to close front door 15). As it becomes necessary for the operator to install the developer supply container 1A into the apparatus main assembly 100, first, the operator is to open the front door 15, and then, slide the developer supply container 1A onto the tray 201*k* in the direction indicated by the arrow mark a. When the operator is sliding the developer supply container 1A onto the tray 201*k*, it does not matter whether or not the return force catching portion 4*b* of the developer supply container 1A is in contact with the container returning member 201*g* of the developer hopper 201*a*. Here, FIG. 8(*a*) shows the case in which the return force catching portion 4*b* is not in contact with the container returning portion 201*g*.

At this point in the operation, it is unnecessary for the developer supply container 1A to be precisely placed in a preset point on the tray 201*k*; the developer supply container 1A has only to be inserted a certain distance for the front door 15 to be enabled to be closed. More concretely, as long as the developer supply container 1A is inserted a certain distance into the apparatus main assembly 100 for the door catching portion 1*a* of the developer supply container 1A to come into contact with the front door 15 as the front door 10 is closed, it does not matter how far the developer supply container 1A is inserted into the apparatus main assembly 100. In terms of the direction parallel to the axial line of the developer supply container 1A, the point at which the front door 15 comes into contact with the door catching portion 1*a* is to be in the fan-shaped area, contoured by a dotted line, which the front door 15 sweeps as it is pivotally rotated about its pivot 15*a* (shaft by which front door 15 is supported) to be opened or closed.

FIG. 8(*b*) shows the state of the combination of the developer supply container 1A and front door 15, immediately after the front door came into contact with the door catching portion 1*a* of the developer supply container 1A as it is closed. The apparatus main assembly 100 and developer supply container 1A are structured so that as the front door 15 is closed after the developer supply container 1A was inserted into the apparatus main assembly 100 by a certain distance as shown in FIG. 8(*a*), it comes into contact with a part of the door catching portion 1*a*. Then, as the operator further closes the front door 15, a part of the force applied to the front door 15 by the operator to close the front door works in the direction to push the door catching portion 1*a* (developer supply container 1A) inward of the apparatus main assembly 100. Thus, the developer supply container 1A is moved inward (direction indicated by arrow mark a) of the apparatus main assembly 100 while sliding on the tray 201*k*.

Thus, once the developer supply container 1A is placed on the tray 201*k* by the operator as described above, the developer supply container 1A is automatically inserted all the way into the apparatus main assembly 100 (developer hopper 201*a*) as the operator simply closes the front door 15 of the apparatus main assembly 100.

Further, as the front door 15 is further closed by the operator after the front door 15 has come into contact with the door catching portion 1*a* of the developer supply container 1A, the developer supply container 1A is moved inward (direction indicated by arrow mark a), with the returning force catching portion 4*b* remaining in contact with the container returning member 201*g*. If the operator happens to move the operator's hand away from the front door 15 while the operator is still closing the front door 15 after the front door 15 has come into contact with the door catching portion la, the developer supply container 1A is pushed back, while sliding on the surface of the tray 201*k*, in the opposite direction from the direction (indicated by arrow mark a) in which it was being pushed by the front door 15, by the force generated by the container returning member 201*g*. Therefore, it is desired that the container returning member 201*g* is constructed so that the amount of force (resiliency) which the container returning member 201*g* generates is sufficient to move the door catching portion 1*a* of the developer supply container 1A back into the aforementioned fan-shaped range contoured by the dotted line. This structural arrangement is desired to ensure that as the front door 15 is closed next time, the door catching portion 1*a* is pushed by the front door 15 in the direction (indicated by arrow mark a) as shown in FIG. 8(*a*). Incidentally, the amount of the force which the container returning member 201*g* generates needs to be set in consideration of the amount of force which the tension spring 201*h* generates, friction between the developer supply container 1A and tray 201*k*, weight of the developer supply container 1A, and the like factors.

Since the apparatus main assembly 100 and developer supply container 1A are structured as described above, if the operator pushed the developer supply container 1A too far into the apparatus main assembly 100 (developer hopper 201*a*), the developer supply container 1A is pushed back by the container returning member 201*g*. Therefore, it is unnecessary for the developer supply container 1A to be precisely positioned in the apparatus main assembly 100 (developer hopper 201*a*).

FIG. 9(*a*) shows the state of the combination of the developer supply container 1A and front door 15 while the developer supply container 1*a* is moved inward (direction indicated by arrow mark a) of the apparatus main assembly 100 as the front door 15 is closed further after the front door 15 has come into contact with the door catching portion 1*a* of the developer supply container 1A. As the front door 15 is closed, the door catching portion 1*a* of the developer supply container 1A is moved inward (indicated by arrow mark a) of the apparatus main assembly 100 by the movement of the front door 15 while remaining in contact with the front door 15. Further, the sealing member 2 is pushed into the driving force transmitting portion 201*m* of the apparatus main assembly 100, and therefore, the catches 2*a* of the sealing member 2 engage with the sealing member engaging portion (unshown) of the driving force transmitting portion 201*m* by elastically deforming, in terms of the direction parallel to the axial line of the developer supply container 1A and also, the diameter direction of the developer supply container 1A.

FIG. 9(*b*) shows the state of the combination of the developer supply container 1A and front door 15 immediately after the operator closed the front door all the way, and the developer outlet 4*a* of the developer supply container 1A was unsealed by the movement of the sealing member 2. That is, as the developer supply container 1A is inserted all the way into the apparatus main assembly 100 (developer hopper 201*a*) in the direction (indicated by arrow mark a) by the last push on the front door 15 from the operator, the sealing member 2 becomes engaged with the driving force transmitting portion 201*m*, and unseals the developer outlet 4*c* of the small diameter portion 4*a* of the developer supply container 1A by being moved relative to the developer supply container 1A in the direction (indicated by arrow mark a) parallel to the axial line of the developer supply container 1A by the movement of the front door 15. Consequently, it becomes possible for the developer supply container 1A to supply the developer therein to the developer hopper 201*a*. It also becomes possible for the developer supply container 1A to receive the rotational driving force to be rotated together with the sealing member 2 by the rotational driving force.

After the front door 15 is closed, it is held to the apparatus main assembly 100. The means for holding the front door 15 to the apparatus main assembly 100 may be a latch, a hook, a magnet, or the like (unshown). The amount of force with which the front door 15 is to be held to the apparatus main assembly 100 is set to be sufficient to keep the door 15 held to the apparatus main assembly 100 against the force generated by the container returning member 201*g* even while the developer supply container 1A is rotated.

As described with reference to FIGS. 8 and 9, the above described structural arrangement in accordance with the present invention, which is very simple in design, can ensure that as the front door 15 is closed by an operator, the developer supply container 1A is precisely set in the apparatus main assembly 100.

If the developer supply container 1A is placed in a position P1 indicated by dotted lines in FIG. 8(*a*), the front door 15 cannot be closed all the way. That is, the position P1 is located clearly too far frontward (outward indicated by arrow mark a) from the proper range in which the developer supply container 1A is to be placed before an operator to begins to close the door 15. In this case, as soon as the operator begins to close the front door 15, the front door 15 comes into contact with a point 1*f'* of the main section if of the developer supply container 1A. Therefore, if the operator applies more force to close the front door 15, the developer supply container 1A is tilted by the movement of the front door 15, and the rear end of the developer supply container 1A comes into contact with the ceiling portion 201*l* of the developer hopper 201*a*, preventing thereby the developer supply container 1A from being moved further inward. Thus, the front door 15 cannot be closed further. Therefore, the force which was generated by the closing movement of the front door 15 in the direction to move the developer supply container 1A inward of the apparatus main assembly 100 cannot be generated any more. This situation that the interaction between the developer supply container 1A and the ceiling 201*l* of the developer hopper 201*a* is preventing the front door 15 from being closed further can be easily observed by the operator. In other words, the operator can easily recognize that all that has to be done to completely close the front door 15 is to move the developer supply container 1A into the range which allows the front door 15 to be fully closed, that is, the range in which the front door catching portion 1*a* of the developer supply container 1A falls within the fan-shaped area contoured by the dotted line in FIG. 8, and then, try to close the front door 15 again.

A point P2 indicated by dotted lines in FIG. 8(*a*) is where the developer supply container 1A is when the door catching portion 1*a* is within the fan-shaped area contoured by the dotted line. In this case, as soon as the front door 15 begins to be closed, the front door 15 comes into contact with the rounded portion 1*g'* of the main section 1*f* of the developer supply container 1A. Thus, as the front door 15 is pushed by the operator, a small amount of force is generated by the front door 15 in the direction to push the developer supply container 1A inward (indicated by arrow mark a). Thus, the developer supply container 1A is slid on the tray 201*k* inward (indicated by arrow mark a) of the apparatus main assembly 100. In other words, in this case, the force which works in the direction to insert the developer supply container 1A is generated.

<Principle Based on which Force is Generated in Direction to Move Development Supply Container Inward of Apparatus Main Assembly by Closing Movement of Front Door>

Figure 10:
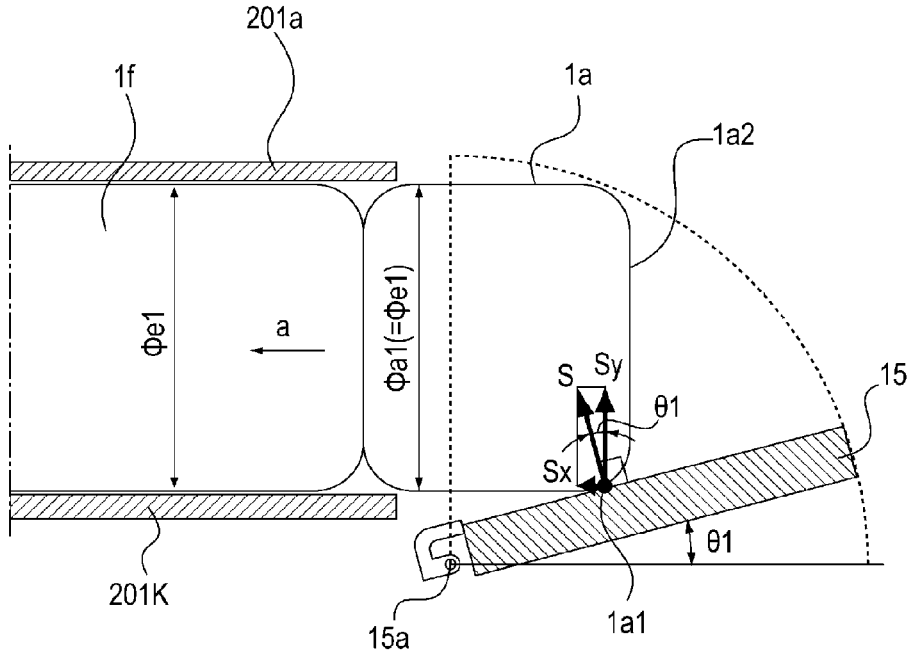
FIG. 10(*a*) is a schematic sectional view of a combination of the rear end portion of the developer supply container, entrance portion of the developer supply container holder, and holder door (lid), wherein the rear end portion is the same in external diameter as the main section of the developer supply container, and FIG. 10(*b*) is a schematic sectional view of a combination of the rear end portion of the developer supply container, entrance portion of the developer supply container holder, and holder door, wherein the rear end portion is smaller in external diameter than the main section of the developer supply container.
Figure 10:
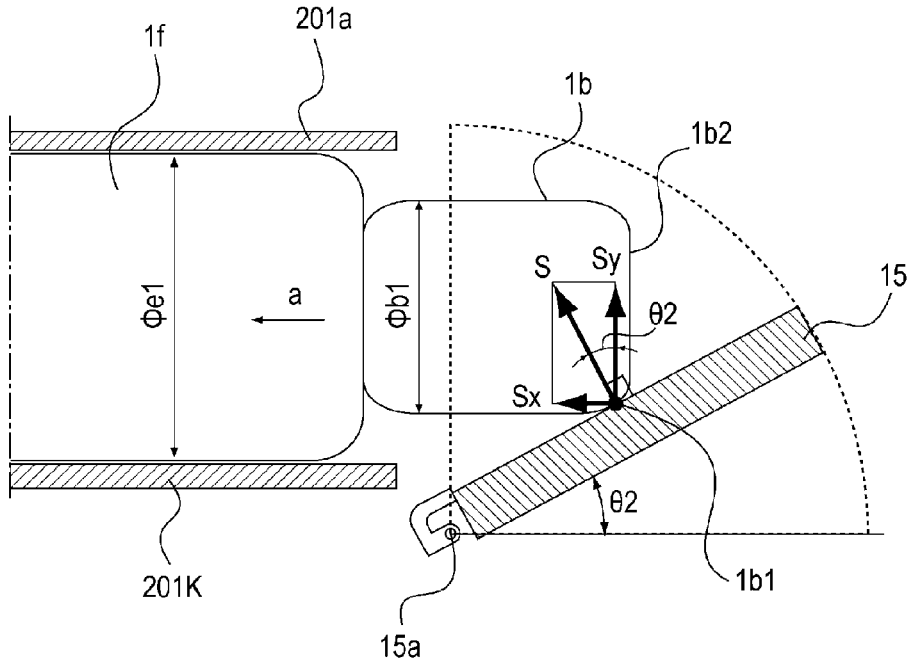

Next, referring to FIG. 10, the principle, based on which the developer supply container 1A is moved inward of the apparatus main assembly 100 by the contact between the door catching portion 1*a* of the developer supply container 1A, and the front door 15, is described in detail. FIG. 10(*a*) is a schematic sectional view of a combination of the rear end portion of the developer supply container 1A, entrance portion of the developer hopper 201*a*, and front door 15, wherein the rear end portion of the developer supply container 1A is the same in external diameter as the main portion of the developer supply container 1A, and FIG. 10(*b*) is a schematic sectional view of a combination of the rear end portion of the developer supply container 1A, entrance portion of the developer hopper 201*a*, and front door 15, wherein the rear end portion of the developer supply container 1A is smaller in external diameter than the main section 1 of the developer supply container 1A. In these drawings, referential codes 1*a*1 and 1*b*1 stand for the portions of the door catching portion 1*a*, which come into contact with the front door 15 as the door 15 is closed, and referential codes 1*a*2 and 1*b*2 stand for the portions of the door catching portion 1*a*, which remain in contact with the front door 15 after the front door 15 is completely closed. Further, the referential codes θ1 and θ2 stand for the angles which the front door 15 forms relative to the horizontal direction during the closing of the front door 15.

FIG. 10(*a*) shows the state of the combination of the developer supply container 1A and front door 15, immediately after the front door has come into contact with the door catching portion 1*a* of the developer supply container 1A as it is closed by an operator. The apparatus main assembly 100 and developer supply container 1A are structured so that as the front door 15 is closed after the developer supply container 1A was inserted into the apparatus main assembly 100 by a certain distance as shown in FIG. 10(*a*), it comes into contact with the portion 1*a*1 of the door catching portion 1*a* of the developer supply container 1A. In the case of the developer supply container 1A shown in FIG. 10(*a*), the external diameter φa1 of the door catching portion 1*a* is roughly the same as the external diameter φe1 of the main section of the developer supply container 1A, and the angle which the front door 15 forms relative to the horizontal direction the moment it comes into contact with the door catching portion 1*a* is θ1. At this moment of contact between the front door 15 and door catching portion 1*a*, the front door 15 is subjected to a force S which is generated by the force applied to the front door 15 by the operator to close the door 15. This force S is perpendicular to the front door 15, and separates into two components, that is, the vertical (upward) and horizontal (inward) components Sx and Sy, respectively. The horizontal (inward) component Sx (=S sin θ) functions as the force which pushes the developer supply container 1A inward (indicated by arrow mark a). Thus, the developer supply container 1A is moved inward (indicated by arrow mark a). However, the external diameter of the door catching portion 1*a* of the developer supply container 1A is the same as that of the main section 1*f* of the developer supply container 1A. Therefore, the angle θ1 is gentle. Thus, the vertical (upward) component Sy is greater than the horizontal (inward) component Sx. In other words, the horizontal (inward) component Sx is insufficient, in spite of its existence.

Next, a case in which the external diameter φa1 of the door catching portion 1*a* is smaller than the external diameter φe1 of the main section of the developer supply container 1A is described. The state of the combination of the developer supply container 1A and front door 15 shown in FIG. 10(*b*) is the same as that shown in FIG. 10(*a*). That is, the position in which the developer supply container 1A is in FIG. 10(*b*) immediately after the placement of the developer supply container 1A on the tray 201*k* is the same as that in which the developer supply container 1A is in FIG. 10(*a*). However, the external diameter ϕb1 of the developer supply container 1A shown in FIG. 10(*b*) is smaller than the external diameter ϕe1 of the main section of the developer supply container 1A. Therefore, the angle θ2, that is, the angle between the front door 15 and the horizontal direction shown in FIG. 10(*b*) is greater than the angle θ1, that is, the angle between the front door 15 and the horizontal direction shown in FIG. 10(*a*). The smaller in diameter the door catching portion 1*a* of the developer supply container 1A relative to the main section of the developer supply container 1A, the greater the angle θ between the front door 15 and the horizontal direction, and therefore, the greater the horizontal (inward) component Sx, making it easier for an operator to close the front door 15 to complete the installation of the developer supply container 1A. In particular, if the angle θ is greater than 45 degrees (θ>45°), the component Sx, or the force which pushes the developer supply container 1A inward (indicated by arrow mark a) of the apparatus main assembly 100, is greater than the vertical component Sy. Therefore, it is even easier for the operator to close the front door 15.

Moreover, the further the front door 15 is closed, the greater the angle θ becomes, and therefore, the greater the horizontal (inward) component Sx. That is, as described previously with reference to FIGS. 7 and 8, as the front door 15 is closed, the developer supply container 1A is gradually moved inward (indicated by arrow mark a) of the apparatus main assembly 100 by the front door 15. Therefore, the angle θ between the front door 15 and the horizontal direction gradually increases, which in turn gradually increases the horizontal component Sx, or the force which pushes the developer supply container 1A inward (indicated by arrow mark a). Therefore, it becomes easier for the operator to close the front door 15.

In this embodiment, the point of contact between the developer supply container 1A and front door 15, at which the force for pushing the developer supply container 1A inward of the apparatus main assembly 100 is generated, is only the point 1*a*1 of contact. However, this embodiment is not intended to limit the present invention in terms of the number of the points of contact between the developer supply container 1A and front door 15. That is, the developer supply container 1A may be provided with two or more points of contact, which come into contact with the front door 15, as long as providing the developer supply container 1A with two or more points of contact which come into contact with the front door 15 has the same in effect as providing the developer supply container 1A with only one point of contact which comes into contact with the front door 15 as in this embodiment. Further, in this embodiment, the door catching portion 1*a* is shaped so that it is circular in cross-section at a plane which coincides with the axial line of the developer supply container 1A. However, the door catching portion 1*a* may be elliptical or triangular, for example, as long as the door catching portion 1*a* is the same in effectiveness as the door catching portion 1*a* in this embodiment, that is, it is shaped so that as the front door 15 presses on the door catching portion 1*a*, a part of the force applied to the front door 15 turns into the force that presses the developer supply container 1A inward (indicated by arrow mark a) of the apparatus main assembly 100. However, in a case where the door catching portion 1*a* of the developer supply container 1A is shaped so that its cross-section is circular as it is in this embodiment, it is unnecessary for an operator to pay attention to the attitude of the door catching portion 1*a* in terms of the rotational direction of the developer supply container 1A. Therefore, shaping the door catching portion 1*a* circular in terms of cross section is preferable from the standpoint of operability.

<Operation for Supplying Apparatus Main Assembly with Developer with Use of Developer Supply Container>

Figure 11:
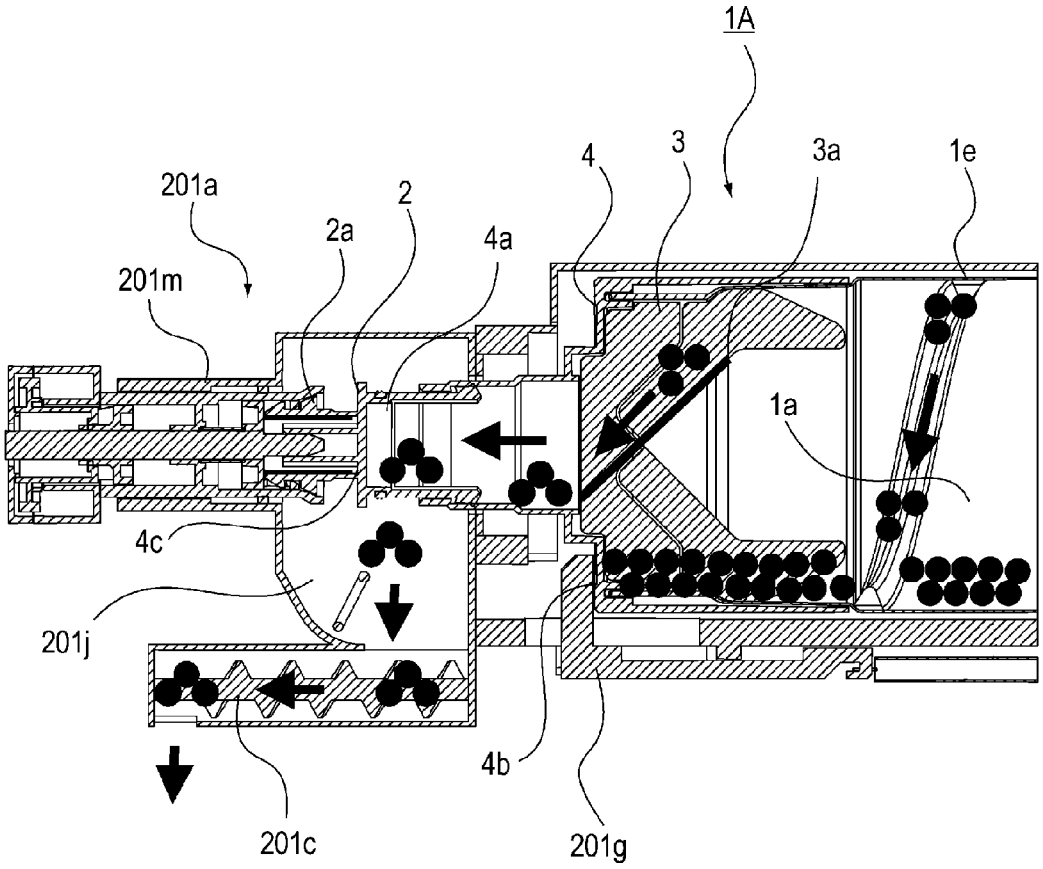
FIG. 11 is a sectional view of a combination of the receptacle portion of the developer supply container holder, and the developer outlet portion of the developer supply container, during the developer delivery from the container to the developer hopper.

Next, referring to FIG. 11, the operation for supplying the apparatus main assembly 100 with developer with the use of the developer supply container 1A is described. FIG. 11 is a sectional view of a combination of the receptacle portion of the developer hopper 201*a*, and the developer outlet portion 4*c* of the developer supply container 1A, during the developer delivery from the container 1A to the developer hopper 201*a*.

The developer supply container 1A is rotated by the rotational driving force transmitted to the developer supply container 1A from the driving force transmitting portion 201*m* through the sealing member 2. As the developer supply container 1A rotates, the developer in the developer supply container 1A is conveyed to the small diameter portion 4*a* of the developer supply container 1A by the spiral ridge le with which the main section 1 of the developer supply container 1*a* is provided. As the developer supply container 1A continues to be rotated, the developer having reached the small diameter portion 4*a* is scooped up by the developer conveying member 3, and then, is transferred onto the plate 3*a*. Since the plate 3*a* is slanted relative to the horizontal direction, the developer on the plate 3*a* is made to slide diagonally downward into the small diameter portion 4*a*. Then, the developer is discharged into the developer chamber 201*j* of the developer hopper 201*a* through the developer outlet 4*c*. The developer in the developer chamber 201*j* is delivered to the developing device of the apparatus main assembly 100 little by little by a preset amount (rate), by the developer conveying member 201*c* while being stirred by the developer conveying member 201*c*.

In this embodiment, the return force catching (bearing) portion 4*b* remains under the pressure from the container returning member 201*g*. Thus, the developer supply container 1A is always kept pressed toward the front door 15, being thereby always kept in the preset position in the apparatus main assembly 100. That is, even while the developer supply container 1A is rotated, the opening (developer passage) created by the unsealing of the developer outlet 4*c* by the movement of the sealing member 2 relative to the developer outlet 4*c*, remains stable in dimension in terms of the direction parallel to the axial line of the developer supply container 1A. Therefore, the amount by which developer is discharged from the developer supply container 1A into the developer chamber 201*j* of the developer hopper 201*a* remains stable. In other words, this embodiment can improve an electrophotographic image forming apparatus in the level of precision at which developer is supplied from a developer supply container 1A to the apparatus main assembly. Further, the positional relationship between the above described opening of the developer outlet 4*c* and the developer chamber 201*j* of the developer hopper 201*a* remains stable, and therefore, the developer from the developer outlet 4*c* always falls on the same spot in the developer chamber 201*j*. Therefore, the developer in the developer chamber 201*j* remains the same in the manner in which it piles in the developer chamber 201*j*. Therefore, the amount (remaining amount) of the developer in the developer chamber 201*j* can be detected at a higher level of accuracy. Further, with the developer remaining the same in the manner in which it piles in the developer chamber 201*j*, the amount by which the developer is conveyed by the developer conveying member 201*c* remains stable.

Further, the image forming apparatus in this embodiment is structured so that while developer is supplied from the developer supply container 1A, the door catching portion 1*a* and front door 15 remain in contact with each other. Thus, the smaller the external diameter ϕa1 of the door catching portion 1*a* is relative to the diameter ϕe1 of the main section of the developer supply container 1A, the smaller the area of contact between the developer supply container 1A and front door 15, and therefore, the smaller the amount of force necessary to rotate the developer supply container 1A.

<Operation for Removing Developer Supply Container>

Figure 12:
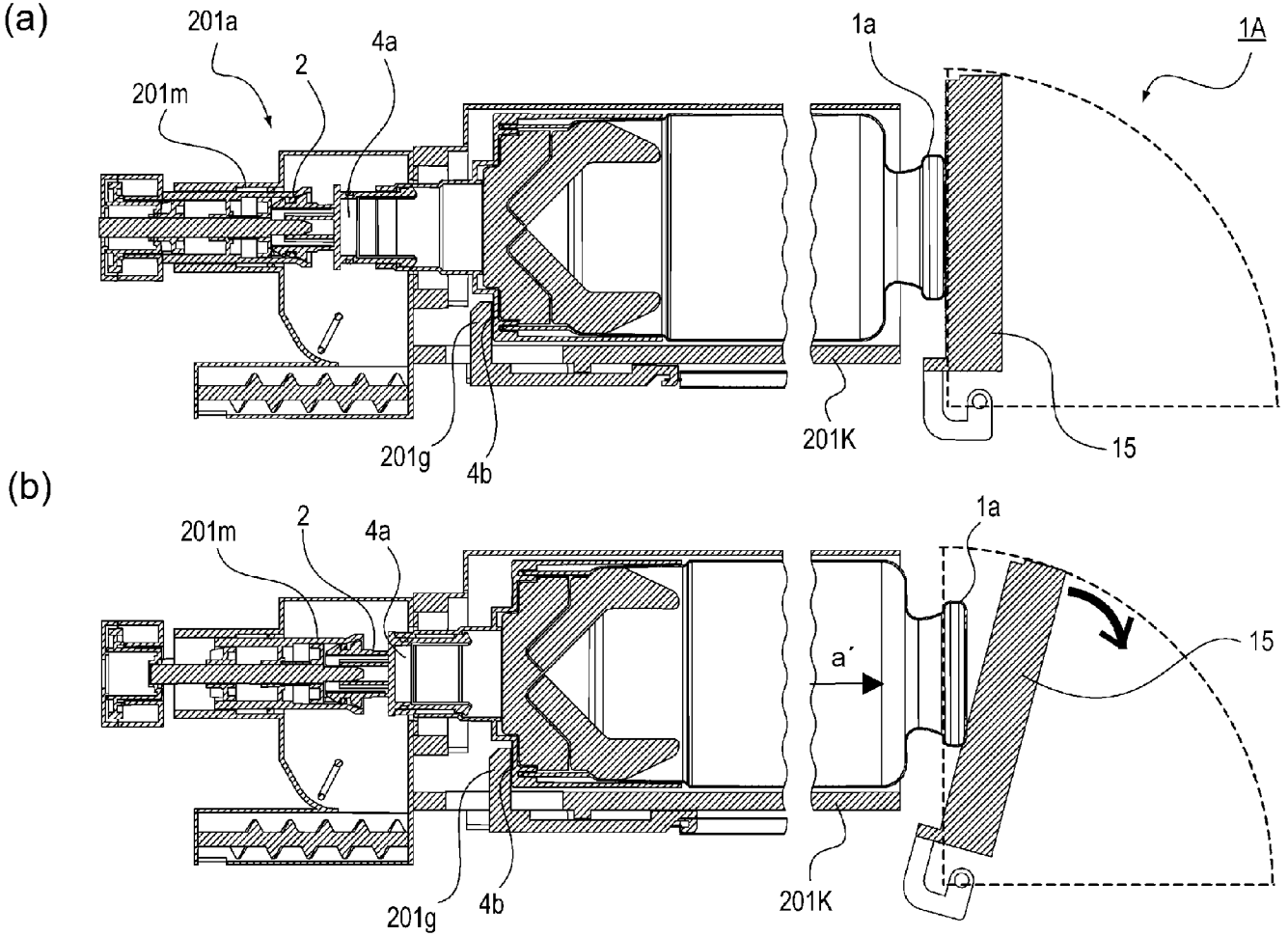
FIGS. 12(*a*) and 12(*b*) are sectional views of the developer supply container and its adjacencies in the developer supply container holder, before and during, respectively, the early stage of removal of the container from the apparatus main assembly.
Figure 13:
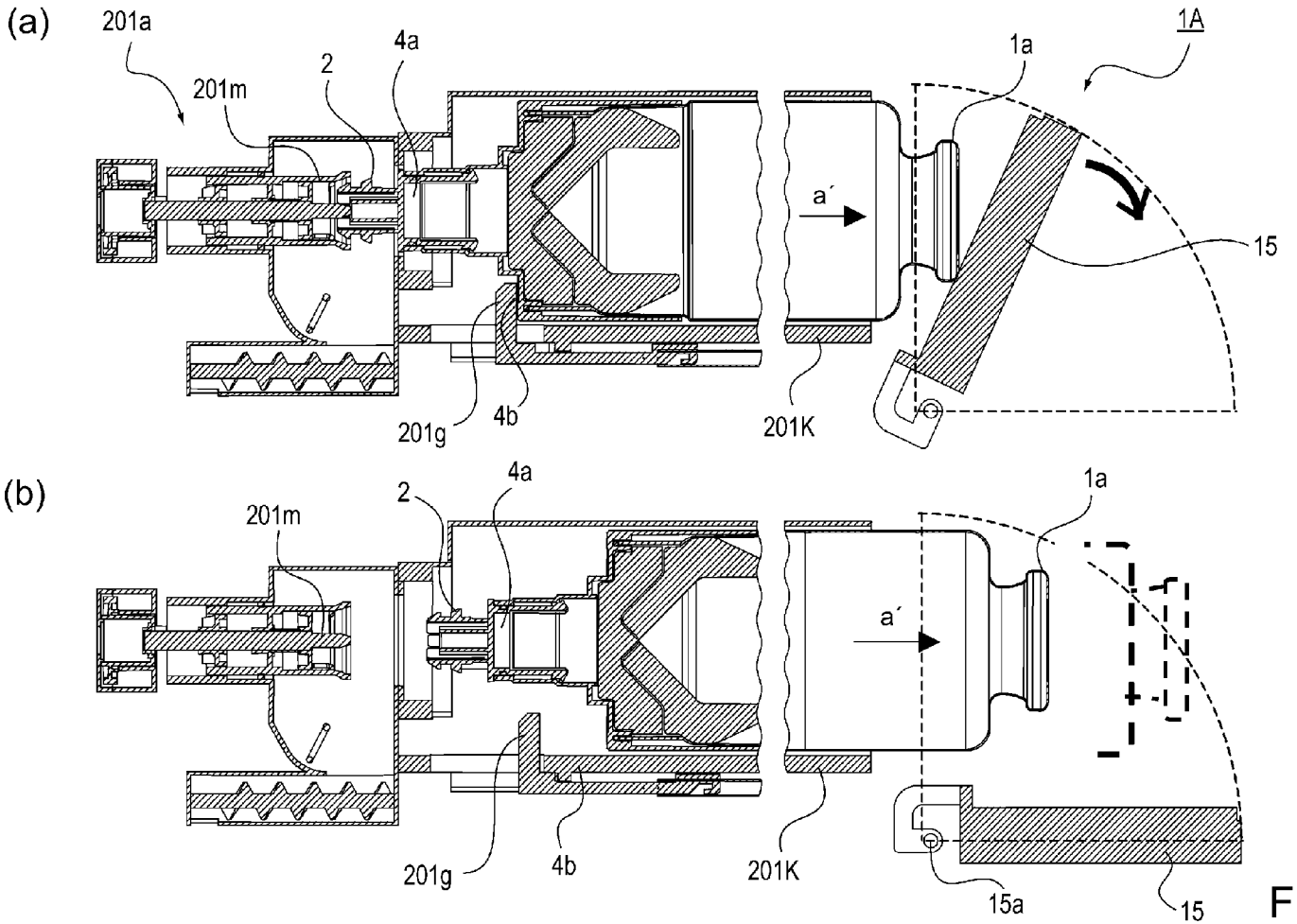
FIGS. 13(*a*) and 13(*b*) are sectional views of the developer supply container and its adjacencies in the developer supply container holder, during and after, respectively, the final stage of removal of the container from the apparatus main assembly.

Next, referring to FIGS. 12 and 13, the operation for removing the developer supply container 1A from the apparatus main assembly 100 is described. FIGS. 12(*a*), 12(*b*), 13(*a*) and 13(*b*) are sectional views of the combination of the driving force transmitting portion 201*m*, developer supply container 1A, and front door 15, and show the various steps through which the developer supply container 1A is removed from the apparatus main assembly 100.

FIG. 12(*a*) shows the state of the combination of the driving force transmitting portion 201*m*, sealing member 2, developer supply container 1A, and front door 15, immediately before the developer supply container 1A begins to be removed from the apparatus main assembly 100. The return force catching portion 4*b* of the developer supply container 1A is under the pressure from the container returning portion 201*g*, and the door catching portion 1*a* is in contact with the front door 15. Further, the driving force transmitting portion 201*m* is in engagement with the sealing member 2, and therefore, the developer outlet 4*c* is open.

FIG. 12(*b*) shows the state of the combination of the driving force transmitting portion 201*m*, sealing member 2, developer supply container 1A, and front door 15, after the front door 15 has been slightly opened. When the combination is in this state, the driving force transmitting portion 201*m* had been moved by the closing movement of the front door 15, in the opposite direction (indicated by arrow mark a') from the direction (indicated by arrow mark a) in which the developer supply container 1A is inserted, and therefore, the opening of the developer outlet 4*c* of the small diameter portion 4*a* of the developer supply container 1A had been sealed by the sealing member 2 which had been moved by the driving force transmitting portion 201*m*. Further, the developer supply container 1A is under the pressure from the return force catching portion 4*b*. Thus, as the front door 15 is opened, the developer supply container 1A moves in the opposite direction (indicated by arrow mark a') from the direction in which it was inserted, by a distance which is proportional to the angle by which the front door 15 was opened. However, the image forming apparatus and developer supply container 1A are structured so that the distance by which the developer supply container 1A is moved by the movement of the front door 15 is substantially smaller than the distance by which the driving force transmitting portion 201*m* by the movement of the front door 15, in order to prevent the sealing member 2 from being prevented from sealing the opening of the developer outlet 4*c*.

FIG. 13(*a*) is a sectional view of the state of the combination of the driving force transmitting portion 201*m*, sealing member 2, developer supply container 1A, and front door 15, after the front door 15 has been opened slightly wider from the position in which it is in FIG. 12(*b*). While the front door 15 is moved from where it is in FIG. 12(*b*) to where it is in FIG. 13(*a*), the catches 2*a* (with claws) of the sealing member 2 are elastically bent toward the axial line of the sealing member 2, being thereby disengaged from the catch portions (unshown) of the driving force transmitting portion 201*m*. Further, developer supply container 1A is moved in the opposite direction (indicated by arrow mark a') from the direction (indicated by arrow mark a) in which the developer supply container 1A was inserted by a distance proportional to the angle by which the front door 15 is opened from where it is in FIG. 12(*b*).

FIG. 13(*b*) is a sectional view of the state of the combination of the driving force transmitting portion 201*m*, sealing member 2, developer supply container 1A, and front door 15, immediately after the front door 15 has been fully opened. When the combination is in the state shown in FIG. 13(*b*), the door catching portion 1*a* of the developer supply container 1A is no longer under the pressure from the front door 15, and therefore, the developer supply container 1A is pushed out of the apparatus main assembly 100 in the opposite direction (indicated by arrow mark a') from the direction (indicated by arrow mark a) in which it was inserted, by the force which it receives from the container returning member 201*g*. It is desired that the developer supply container 1A is moved outward far enough, preferably, far enough for the door catching portion 1*a* of the developer supply container 1A to be in the fan-shaped range contoured by the dotted line in FIG. 13(*b*), so that an operator can easily know that the developer supply container 1A can be removed. The reason why the developer supply container 1A is pushed out of the apparatus main assembly 100 far enough for the door catching portion 1*a* to be in the fan-shaped range is that, with the door catching portion 1*a* being in the fan-shaped area, the operator can reset the developer supply container 1A in the apparatus main assembly 100 simply by closing the front door 15, that is, without adjusting the developer supply container 1A in position. As the developer supply container 1A is pushed out to where it is in FIG. 13(*b*), the operator can take the developer supply container 1A (empty developer supply container 1A) out of the apparatus main assembly 100 simply by pulling the developer supply container 1*a* in the opposite direction (indicated by arrow mark a') from the direction (indicated by arrow mark a) in which the developer supply container 1A was inserted into the apparatus main assembly 100.

As described above with reference to FIGS. 12 and 13, as the front door 15 is opened, the developer supply container 1A is pushed out of the apparatus main assembly 100, on the front side of the apparatus main assembly 100. Further, the length by which the rear end portion (in terms of direction in which it was inserted) of the developer supply container 1A is exposed from the apparatus main assembly 100 is proportional to the angle by which the front door 15 is opened. Thus, the wider the front door 15 is opened, the easier it becomes for the operator to grasp the developer supply container 1A.

That is, all that is necessary for the operator to do in order to remove the developer supply container 1A from the apparatus main assembly 100 is to simply open the front door 15, and take out the developer supply container 1A by grasping the developer supply container 1A. In other words, it is unnecessary to unlock a locking mechanism, to forcefully pull out the developer supply container 1A, or to perform the like operation. That is, this embodiment can improve an image forming apparatus in operability.

In this embodiment, the opening of the developer outlet 4*c* of the small diameter portion 4*a* of the developer supply container 1A is at the end of the outlet 4*c*. However, this embodiment is not intended to limit the present invention in terms of where the opening of the developer outlet 4*c* is to be located. For example, the developer outlet 4*c* may be structured so that the opening is in the cylindrical wall of the developer outlet 4*c*, and is exposed or covered by a shutter slidable along the cylindrical wall. In any case, how the opening of the developer outlet 4*c* is exposed or covered does not matter, as long as it does not interfere with the application of the present invention.

Also in this embodiment, the front door 15 is a secondary door of the apparatus main assembly 100, which is dedicated to the installation and removal (replacement) of the developer supply container 1A. However, the apparatus main assembly 100 may be structured so that the developer supply container 1A is moved into, or out of, the apparatus main assembly 100 by the opening or closing of the primary front door 100*c* of the apparatus main assembly 100.

<Principle on which Operation of Return Mechanism is Based>

Figure 14:
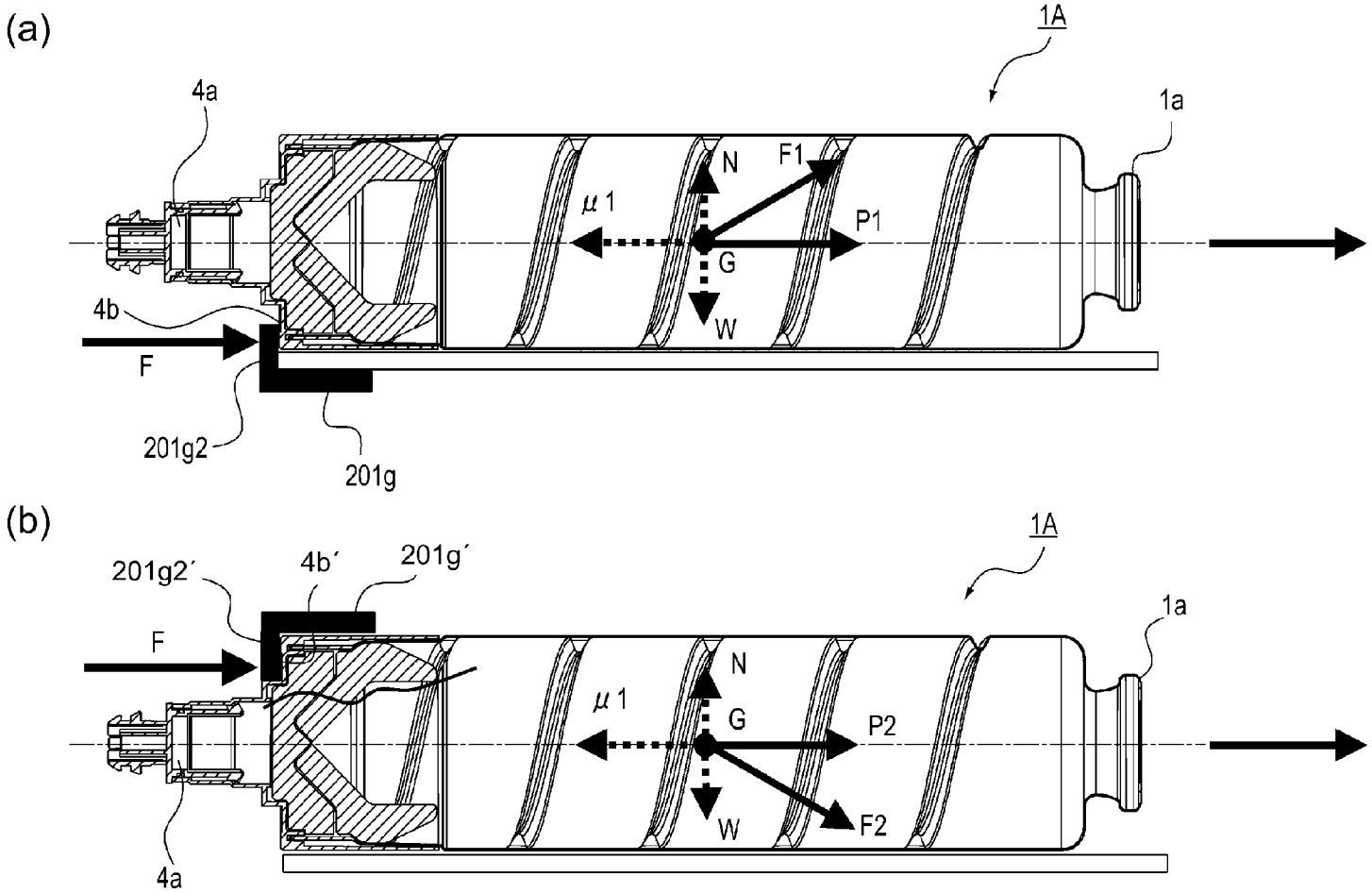
FIGS. 14(*a*) and 14(*b*) are schematic sectional views of a combination of the developer supply container and a force applied to the container to push back the container, which is for showing how the force for pushing back the developer supply container is distributed when it is applied to the bottom and top portions, respectively, of the container.

Next, referring to FIG. 14, the principle on which the operation of the container return mechanism 201*a* is based is described.

FIG. 14(*a*) is a schematic sectional view of a combination of the developer supply container 1A and container returning member 201*g* in this embodiment of the present invention, wherein the container contacting portion 201*g*2 of the container returning (ejecting) member 201*g* contacts the bottom portion of the developer supply container 1A. FIG. 14(*b*) is a schematic sectional view of a combination of the developer supply container 1A and a comparative container returning member 201*g*', wherein the container contacting portion 201*g*'2 of the comparative container ejecting member 201*g*1' contacts the top portion of the developer supply container 1A. In FIGS. 14(*a*) and 14(*b*), a referential code F stands for the force generated by the container returning (ejecting) member 201*g*; μ1, amount of friction between the developer supply container 1A and tray 201*k*; W, amount of gravity to which developer supply container 1A is subjected; N, vertical reaction force to which the developer supply container is subjected; P1, force by which the developer supply container 1A is pushed; and F1 stands for the force by which the developer supply container 1A is pushed diagonally upward. The center G of gravity of the developer supply container 1A is roughly near the rotational axis of the developer supply container 1A in terms of the diameter direction of the developer supply container 1A, as shown in FIG. 14.

In FIG. 14(*a*), the return pressure catching portion 4*b* is on the bottom side of the center G of gravity of the developer supply container 1A in terms of the vertical direction, and is under the pressure F generated by the container returning member 201*g*. Thus, the force F1 which presses the developer supply container 1A diagonally upward (in FIG. 14(*a*)) is generated by the force F. Consequently, the developer supply container 1A tends to be tilted in such an attitude that its rear end (door catching portion 1*a*) moves upward. Thus, the friction μ1 reduces, making it easier for the developer supply container 1A to be smoothly moved outward of the apparatus main assembly 100.

In comparison, in FIG. 14(*b*), the return pressure catching portion 4*b* is on the top side of the center G of gravity of the developer supply container 1A in terms of the vertical direction, and is under the pressure F generated by the container returning member 201*g*. Thus, the force F2 which presses the developer supply container 1A diagonally downward (in FIG. 14(*a*)) is generated by the force F. Consequently, the rear end (door catching portion 1*a*) of the developer supply container 1A tends to be pressed downward. Thus, the friction μ1 increases, making it more difficult for the developer supply container 1A to be smoothly moved outward of the apparatus main assembly 100.

As described above, in this embodiment, the apparatus main assembly 100 and developer supply container 1A are structured so that regardless of the attitude of the developer supply container 1A in terms of its rotational direction, it is always the bottom portion (relative to center G of gravity of developer supply container 1A) of the return force catching portion 4*b* that catches the force F from the container returning member 201*g*. Therefore, the friction between the developer supply container 1A and tray 201*k* is significantly smaller than the friction between the developer supply container (1A) and tray (201*k*) of the image forming apparatus structured so that the force generated by the container returning member 201*g* is borne by the top side of the return force catching portion 4*b*. That is, this embodiment (present invention) can make the friction between the developer supply container 1A and tray 201*k* substantially smaller, and therefore, can more smoothly move the developer supply container 1A outward of the apparatus main assembly 100 (developer hopper 201*a*) than the prior art. Thus, it makes it possible to reduce the container returning mechanism 201A in the amount of the force for pushing the developer supply container 1A outward of the apparatus main assembly 100, that is, the amount of the force against which the operator has to press the front door 15 to close the front door 15 when the developer supply container 1A is on the tray 201*k*. In other words, this embodiment can significantly improve an electrophotographic image forming apparatus in terms of how easily and reliably the developer supply container 1A can be installed into, or removed from, the apparatus main assembly by an operator.

Further, in this embodiment, the apparatus main assembly 100 and developer supply container 1A are structured so that the developer supply container 1A tends to tilt in such an attitude that the door catching portion 1*a* (rear end portion) of the developer supply container 1A floats, as described above. Therefore, when the developer is delivered from the developer supply container 1A in this embodiment into the apparatus main assembly 100 in this embodiment as described with reference to FIG. 11, the amount by which the developer in the developer supply container 1A is left undeliverable in the developer supply container 1A is substantially smaller than that when the developer is delivered from the developer supply container in accordance with the prior art into the apparatus main assembly in accordance with the prior art. That is, the developer supply container 1A in this embodiment tends to be tilted be in such an attitude that its rear end (door catching portion 1*a*) is positioned higher than its front end (smaller diameter portion 4*a*). Therefore, the developer in the developer supply container 1A is likely to collect on the developer outlet side of the developer supply container 1A, making it easier for the developer conveying member 3 to scoop up the developer. Thus, this embodiment can improve a developer supply container in the efficiency with which it can discharge the developer, and therefore, can reduce a developer supply container in the amount by which the developer is left undeliverable therein.

As described above, this embodiment makes it possible to properly set a developer supply container in the main assembly of an electrophotographic image forming apparatus simply by inserting the developer supply container by a certain distance into the main assembly and closing the front door of the apparatus. That is, this embodiment makes it unnecessary to insert a developer supply container into the main assembly of an image forming apparatus so that the container is exactly placed in a preset position in the apparatus main assembly, when installing the developer supply container in the apparatus main assembly.

Further, this embodiment makes it possible that as the front door of the apparatus main assembly is opened, the developer supply container is automatically moved in the opposite direction from the direction in which it was inserted, by a distance large enough for its substantial portion to be exposed from the apparatus main assembly. Thus, when an operator wants to remove the developer supply container, the operator has only to open the front door and pick up the container. In other words, this embodiment makes it unnecessary for the operator to perform such an operation as disengaging the front door lock, unlatching the front door, or the like, each time the operator wants to remove the developer supply container in the developer supplying device.

In other words, this embodiment can provide a developer supply container which is significantly superior in usability to any developer supply container in accordance with the prior art. More specifically, it can provide a developer supply container which is significantly smaller in the amount of work load to which the operator is subjected when removing or installing the developer supply container during the replacement of the developer supply container in the apparatus main assembly, to any developer supply container in accordance with the prior art.

Modified Version of Preceding Embodiment

Figure 15:
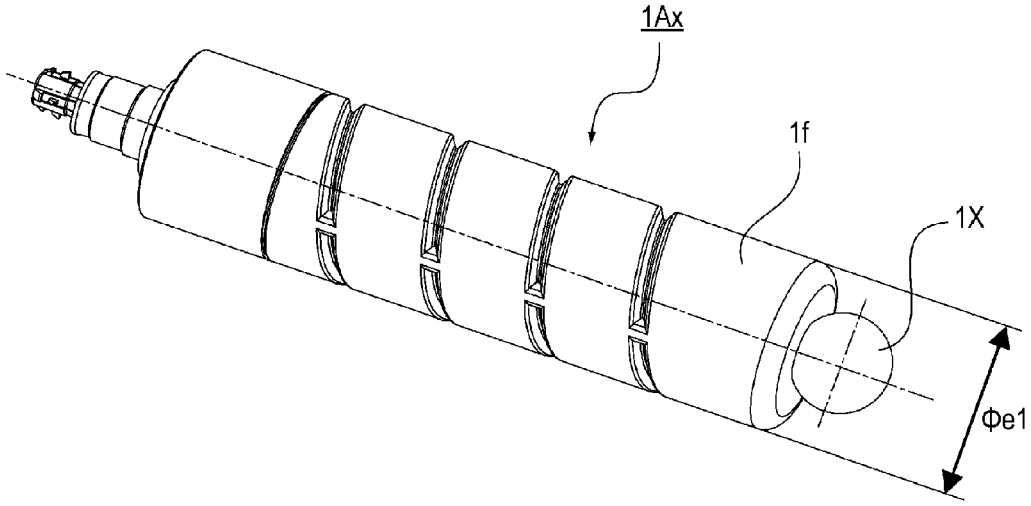
FIGS. 15(*a*) and 15(*b*) are perspective views of the developer supply containers in the first and second modified versions of the embodiment, and show the door catching portions 1X and 1Y, respectively, of the developer supply containers.
Figure 15:
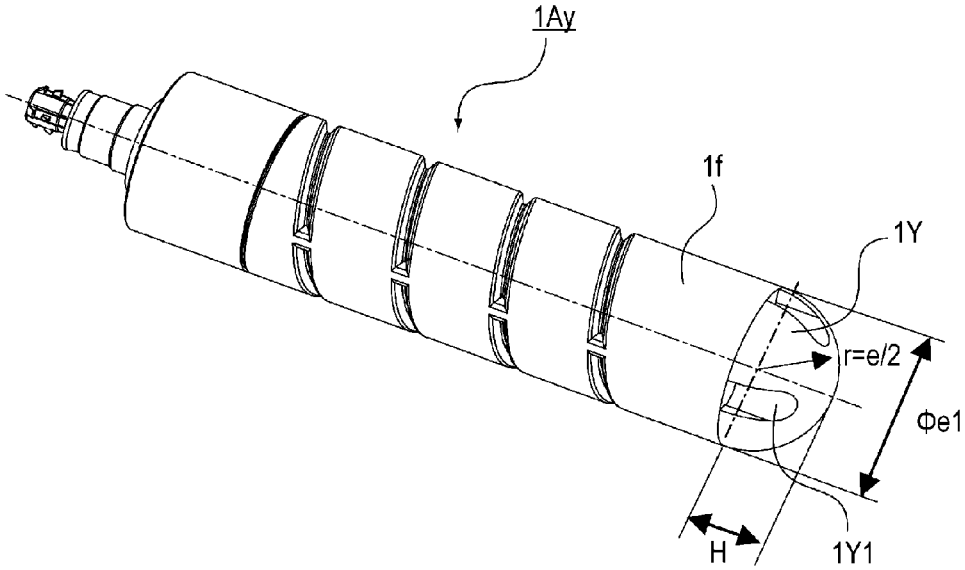
Figure 16:
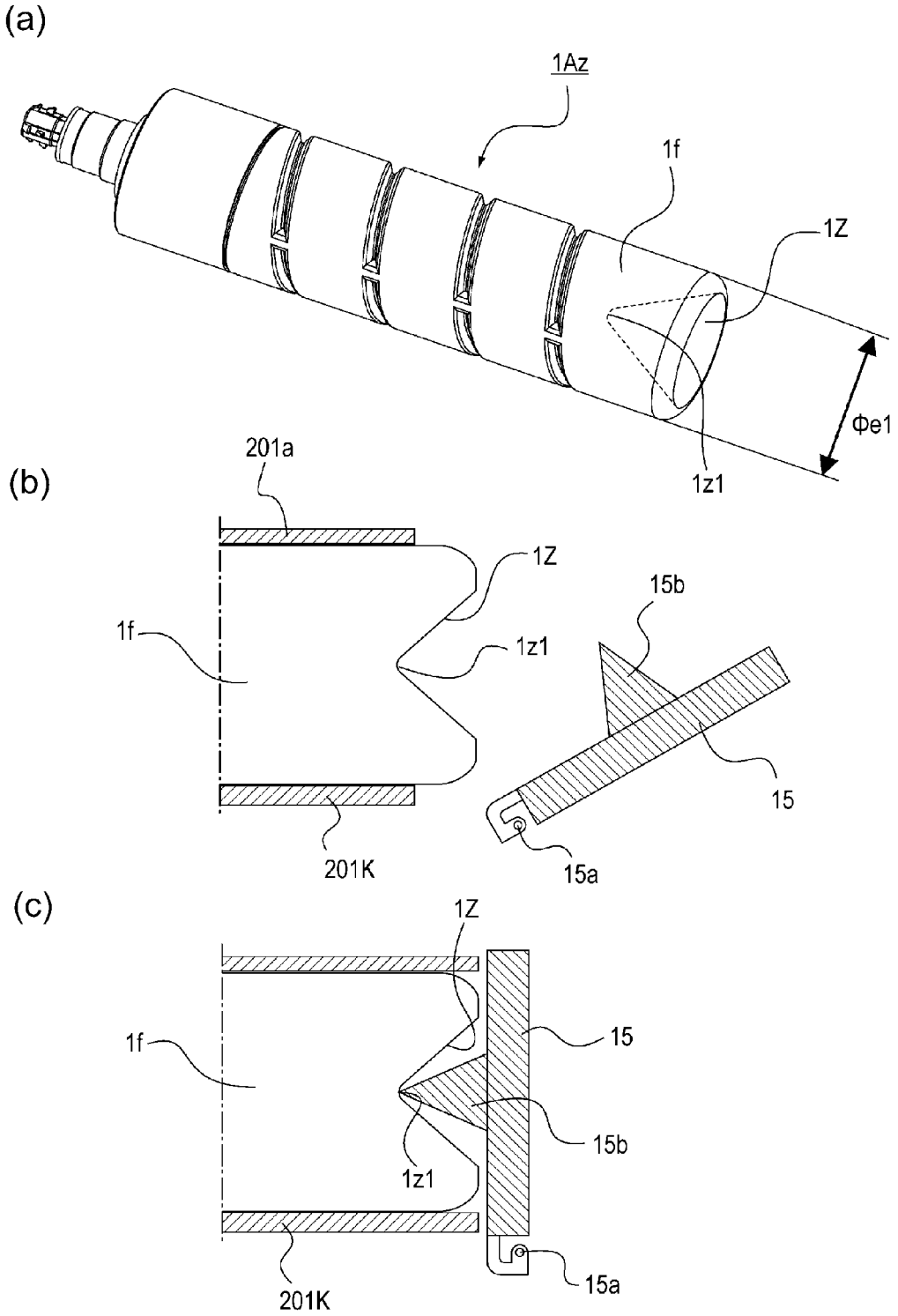
FIG. 16(*a*) is a perspective view of a developer supply container in the third modified version of the embodiment, and shows the door catching portion 1Z of the developer supply container, and FIGS. 16(*b*) and 16(*c*) are sectional views of a combination of the rear end portion of the developer supply container shown in FIG. 16(*a*), and the developer supply container holder door, which is shaped to accommodate the container shown in FIG. 16(*a*), during and after, respectively, the insertion of the container into the holder.

Next, referring to FIGS. 15 and 16, a modified version of the developer supply container 1A in the preceding embodiment of the present invention is described.

FIGS. 15(*a*) and 15(*b*) are perspective views of the modified versions 1 and 2, respectively, of the developer supply container 1A in the preceding embodiment of the present invention. The modified version 1 is different from the original, or the one in the preceding embodiment, in that its door catching portion 1X is virtually spherical, and is smaller in diameter than the main section 1 of the developer supply container 1X. The modified version 2 is different from the original, in that its door catching portion 1Y is virtually semispherical. FIGS. 16(*a*)-16(*c*) show the modified version 3, which is different from the original, in that its door catching portion 1Z has a funnel-like concave shape. These modified versions are different from the original only in the shape of their door catching portions. That is, their portions other than their door catching portion are the same as the counterparts of the original, and therefore, are not going to be described here.

The door catching portion 1X shown in FIG. 15(*a*) is virtually spherical, and is smaller in diameter than the main section if of the developer supply container 1Ax. The door catching portion 1Y shown in FIG. 15(*b*) is semispherical. After the installation of the developer supply containers 1Ax and 1Ay into the apparatus main assembly, the door catching portions 1X and 1Y are rotated in contact with the front door 15, remaining in point contact with the front door 15. Therefore, they are smaller in the amount of friction relative to the front door 15, being therefore in the amount of load to which they are subjected while they are rotated, than that of the original. Further, because the door catching portion 1X is virtually semispherical, the developer supply container 1Ax is constricted across the joint between the main section and door catching portion 1X. Therefore, the developer supply container 1Ax, or the modified version 1, is easier for an operator to grasp, being therefore superior in operability than the original, because the operator can place his or her fingers around the constricted portion. In the case of the door catching portion 1Y, it is provided with four recesses 1Y1, which are large enough to accommodate the fingers of an operator. Therefore, the developer supply container 1Ay, or the second modified version, is easier for an operator to grasp than the original, being therefore superior in operability than the original, when the operator removes the developer supply container 1A.

The door catching portion 1Z shown in FIG. 16 is concave across the rear end surface. FIG. 16(*a*) is a perspective view of the modified version 3 of the developer supply container 1A in the preceding embodiment, and FIG. 16(*b*) is a sectional view of a combination of the rear end portion of the door catching portion 1Z and the front door 15, at a plane which coincides with the axial line of the developer supply container 1Az when the front door 15 is half closed. Further, FIG. 16(*c*) is a sectional view of the combination of the rear end portion of the developer supply container 1Az and the front door 15, after the front door 15 was closed after the insertion of the developer supply container 1Az into the developer hopper 201*a*.

The front door 15 is provided with a pointed projection 15*b*. After the proper setting of the developer supply container 1Az in the apparatus main assembly, the developer supply container 1Az is rotated, with its door catching portion 1Z remaining in contact with the tip of the pointed projection 15*b* of the front door 15. Therefore, the axial line of the developer supply container 1Az becomes coincidental to the rotational axis of the developer supply container 1Az, preventing thereby the problem that as the developer supply container 1Az is rotated, it shakes, vibrates, and/or becomes noisy. Thus, the modified version 3 of the preceding embodiment can also prevent the problem that the image forming apparatus is made to output nonuniform images, by the vibration transmitted to the image formation sections (optical portion 103, photosensitive drum 104, etc.).

In the preceding embodiment, the door catching portion 1*a* was formed as an integral part of the main section 1*f* of the developer supply container 1A. However, the preceding embodiment is not intended to limit the present invention in terms of the shape (structure) of the developer supply container 1A. For example, the developer supply container 1A may be structured so that the door catching portion 1*a* is rotational relative to the main section 1 of the developer supply container 1A. With the door catching portion 1*a* being rotational relative to the main section 1, the load to which the main section 1 of the developer supply container 1A is subjected is substantially smaller than with the developer supply container 1A being not rotational to the main section 1, even if the developer supply container 1A is structured so that the area (point) of contact between the door catching portion 1*a* and front door 15 is relatively large.

The structurally modified versions 1, 2 and 3 of the combination of the developer supply container and front door in the preceding embodiment can also ensure that an operator can easily and precisely set the developer supply container 1A in the apparatus main assembly 100, and also, remove the developer supply container 1A from the apparatus main assembly 100, by simply opening or closing the front door 15 of the apparatus main assembly 100, as the combination in the preceding embodiment can.

In the preceding embodiment, the image forming apparatus was a printer. However, the preceding embodiment is not intended to limit the present invention in terms of the type of image forming apparatus. That is, the present invention is applicable to other image forming apparatuses than the printer. For example, it is applicable to a copying machine, a facsimile machine, and a multifunction image forming apparatus capable of functioning as two or more of these machines. In other words, the effects which can be obtained by applying the present invention to the developer supply container and developer supplying system of each of these image forming apparatuses are the same as those obtained by the developer supply container and developer supplying system in the preceding embodiment.

As will be evident from the description of the preceding embodiment of the present invention given above, according to the present invention, a developer supply container can be precisely set in the developer supplying device by inserting the developer supply container into the main assembly of an image forming apparatus by a reasonable distance, and simply closing the front door of the apparatus. That is, the present invention makes it unnecessary for the developer supply container to be exactly placed in a preset position in the apparatus main assembly.

Also according to the present invention, as the front door is opened when a developer supply container is in the main assembly of an image forming apparatus, the developer supply container is automatically moved in the opposite direction from the direction in which the developer supply container was inserted, by a distance large enough to expose the substantial portion of the rear end portion of the developer supply container. Thus, all that is necessary for an operator to do to remove the developer supply container in the apparatus main assembly is to simply open the front door of the apparatus main assembly, and pick up the container. In other words, the combination of the developer supply container and developer supplying system does not require a developer supply container locking system or the like, which has to be disengaged to remove the developer supply container from the apparatus main assembly.

Therefore, the present invention can provide a developer supply container which is significantly smaller in the amount of work load to which an operator is subjected when the operator pulls out the developer supply container in the main assembly of an image forming apparatus, or inserts a replacement developer cartridge into the apparatus main assembly, than any developer supply container in accordance with the prior art. That is, the present invention can provide a developer supply container which is significantly superior in operability than any developer supply container in accordance with the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 032393/2012 filed Feb. 17, 2012 which is hereby incorporated by reference.

What is claimed is:

1. A developer container detachably mountable to a developer replenishing apparatus, comprising:

a cylindrical accommodation member configured to accommodate a developer;

a coupling portion, provided at one end portion side of said accommodation member, configured to engage with a main assembly coupling portion provided on the developer replenishing apparatus and to receive a rotational force from the developer replenishing apparatus;

an opening configured to permit discharge of the developer from said accommodation member;

a feeding portion configured to feed the developer to said opening by rotating said accommodation member by the rotational force received by said coupling portion;

a contact portion configured to contact an urging portion provided in the developer replenishing apparatus, said contact portion receiving a push-off force from the developer replenishing apparatus in a direction opposite to an inserting direction in which said developer container is inserted into the developer replenishing apparatus; and an engaging portion provided upstream of said contact portion with respect to the inserting direction, said engaging portion being engageable with an opening and closing portion provided in the developer replenishing apparatus to receive a force from the opening and closing portion in the inserting direction and against the push-off force in a closing operation of the opening and closing portion to engage said coupling portion with the main assembly coupling portion when said developer container is inserted into the developer replenishing apparatus.

2. A developer container according to claim 1, wherein said engaging portion is projected from an other end portion of said accommodation member in an axial direction of said developer container.

3. A developer container according to claim 1, wherein said engaging portion is spherical.

4. A developer container according to claim 1, wherein said engaging portion is provided so that said engaging portion and said accommodation member are rotatable integrally.

5. A developer container according to claim 1, wherein said engaging portion is provided so that said engaging portion is rotatable relative to said accommodation member.

6. A developer container according to claim 5, wherein said engaging portion is spherical.

7. A developer container according to claim 1, wherein said engaging portion has a funnel-like concave shape.

* * * * *